US012498202B2

(12) United States Patent
Tunis, III et al.

(10) Patent No.: US 12,498,202 B2
(45) Date of Patent: Dec. 16, 2025

(54) BALLISTIC SHIELD WITH REMOTE VIEWING SCOPE

(71) Applicant: Hardwire, LLC, Pocomoke City, MD (US)

(72) Inventors: George C. Tunis, III, Ocean City, MD (US); Steven J. Winckler, Middle Grove, NY (US); Justin Gordon, Snow Hill, MD (US)

(73) Assignee: Hardwire, LLC, Pocomoke City, MD (US)

( * ) Notice: Subject to any disclaimer, the term of this patent is extended or adjusted under 35 U.S.C. 154(b) by 11 days.

(21) Appl. No.: 18/402,516

(22) Filed: Jan. 2, 2024

(65) Prior Publication Data

US 2025/0164218 A1 May 22, 2025

Related U.S. Application Data

(60) Provisional application No. 63/436,399, filed on Dec. 30, 2022.

(51) Int. Cl.
*F41H 5/26* (2006.01)
*F41H 5/08* (2006.01)

(52) U.S. Cl.
CPC ..... *F41H 5/263* (2013.01); *F41H 5/08* (2013.01)

(58) Field of Classification Search
CPC ..... F41H 5/08
USPC ..... 89/36.05
See application file for complete search history.

(56) References Cited

U.S. PATENT DOCUMENTS 1,279,571 A * 9/1918 Moloney ..... F41H 5/08 2/2.5

FOREIGN PATENT DOCUMENTS

GB 191505239 A * 4/1915

* cited by examiner

*Primary Examiner* — Bret Hayes
(74) *Attorney, Agent, or Firm* — Verrill Dana, LLP

(57) ABSTRACT

Provided herein are remote viewing shields including a ballistic shield and a remote viewing scope mounted to the ballistic shield and including a viewing port located behind the shield and positioned to permit user viewing of threats in front of the shield by looking around the shield.

28 Claims, 29 Drawing Sheets

BALLISTIC SHIELD WITH REMOTE VIEWING SCOPE

CROSS REFERENCE TO RELATED APPLICATIONS

This application claims benefit under 35 U.S.C. § 119(e) of U.S. Provisional Application No. 63/436,399, filed on 30 Dec. 2022, entitled "Ballistic Shield with Remote Viewing Scope," the entirety of which is incorporated by reference herein.

BACKGROUND

Solid ballistic shields are often used as protection from an active shooter. However, such shields lack safe visibility of a threat, and are therefore generally less protecting than shields that do have a safe viewing feature, like a window. Shields with windows do offer enhanced visibility, but there are drawbacks to the added window, including that the window itself may not offer the protection level of the base armor, adds considerable weight to the shield, contributes to a significantly higher cost, and requires added maintenance.

SUMMARY

Provided herein are ballistic shields with remote view scopes. These ballistic shields can be handheld or incorporated into other devices or structures such as, for example, boats, vehicles, or buildings. In general, the ballistic shields can include a solid ballistic shield having an optical device configured for viewing an area otherwise obscured by the shield. For example, in some embodiments the optical device can include a periscope having a first end extending above, below, or to a side of the ballistic shield for redirecting imagery of threat to a second end positioned behind the ballistic shield for viewing by a user protected by the shield.

In one aspect, a remote viewing shield is provided. The remote viewing shield includes a ballistic shield. The remote viewing shield also includes a remote viewing scope mounted to the ballistic shield and including a viewing port located behind the shield and positioned to permit user viewing of threats in front of the shield by looking around the shield.

In some embodiments, the remote viewing scope is mounted at a top of the ballistic shield to provide a view over a top of the ballistic shield. In some embodiments, the remote viewing scope is mounted at a side of the ballistic shield to provide a view around the side of the ballistic shield. In some embodiments, the remote viewing shield also includes a second remote viewing scope mounted at a side of the ballistic shield to provide a view around the side of the ballistic shield. In some embodiments, the remote viewing scope is repositionable between a top mount position to provide a view over a top of the ballistic shield and one or more side positions to provide a view around a side of the ballistic shield. In some embodiments, the remote viewing scope is repositionable between the top mount position, a left side mount position, and a right side mount position. In some embodiments, the remote viewing scope is selectively securable in each of the top mount position, the left side mount position, and the right side mount position by one or more of mechanical or magnetic detents. In some embodiments, the remote viewing scope is removably attachable to and repositionable on the ballistic shield by one or more of hook and loop fasteners, keyhole hangers, hooks, clips, a detent mechanism, or combinations thereof. In some embodiments, the remote viewing scope is repositionable by rotation and/or translation of the remote viewing scope. In some embodiments, the remote viewing scope is repositionable by point rotation about a pin, rotation and/or translation of the remote viewing scope by a four bar linkage, or rotation and/or translation of the remote viewing scope within one or more slots. In some embodiments, the remote viewing shield also includes a trackplate attached to or formed in the ballistic shield and having one or more slots configured to slidably engage an engagement member of the repositionable remote viewing scope. In some embodiments, the trackplate is attached to the ballistic shield by one or more of welding, lamination, adhesives, hook and loop fasteners, mechanical fasteners, or combinations thereof. In some embodiments, the trackplate also includes an outer slot. In some embodiments, the trackplate also includes an inner slot extending at least partially concentrically within the outer slot, wherein the inner and outer slots are configured to slidably engage inner and outer engagement members of the repositionable remote viewing scope. In some embodiments, the remote viewing shield also includes a rocker guide including a rocker configured to tilt responsive to sliding of the engagement member of the repositionable remote viewing scope within the one or more slots of the trackplate. In some embodiments, the rocker guide also includes one or more guide slots configured to slidably engage a guide engagement member of the repositionable remote viewing scope, wherein tilting of the rocker aligns the guide engagement member with one of the one or more guide slots to permit sliding of the engagement member within the aligned one of the one or more guide slots. In some embodiments, the trackplate also includes an outer slot and an inner slot extending at least partially concentrically within the outer slot, wherein the inner and outer slots are configured to slidably engage inner and outer engagement members of the repositionable remote viewing scope. In some embodiments, the rocker guide also includes left and right guide slots configured to slidably engage the guide engagement member of the repositionable remote viewing scope, wherein tilting the rocker rightward aligns the guide engagement member with the right guide slot to permit sliding of the engagement member within the right guide slot and wherein tilting the rocker leftward aligns the guide engagement member with the left guide slot to permit sliding of the engagement member within the left guide slot.

In some embodiments, the remote viewing shield also includes mirrors and/or prisms configured to facilitate remote viewing. In some embodiments, the mirrors and/or prisms are each at least one of flat, convex, or concave. In some embodiments, the remote viewing scope is stowable to protect the mirrors when not in use. In some embodiments, the remote viewing scope is configured to fold flat onto the back of the shield. In some embodiments, the remote viewing scope includes a means to obfuscate the users face from the forward-facing mirror. In some embodiments, the means to obfuscate includes at least one of a hood or a one-way mirror. In some embodiments, the remote viewing scope facilitates the aiming of a defensive weapon by a user by providing a view through sights or a scope of the defensive weapon while a user's head is fully positioned behind the ballistic shield. In some embodiments, the remote viewing shield also includes a forearm support device (FSD) configured to be at least partially supported by a user's forearm to aid in supporting a ballistic shield. In some embodiments, the FSD is mounted on at least one of a left or right side of the shield. In some embodiments, the FSD is configured to be used in combination with a handle of the remote viewing shield. In some embodiments, the FSD is integrated with the handle. In some embodiments, the FSD is configured to function as a steadying device for the forearm of an arm holding a weapon. In some embodiments, the FSD is adjustable to position a user's forearm for aiming of a weapon by the remote viewing scope. In some embodiments, the remote viewing shield also includes hand shield device mounted to the ballistic shield and configured to protect a user's hand when reaching around a ballistic shield. In some embodiments, the hand shield is adjustable in at least one dimension relative to the shield. In some embodiments, the hand shield device is mounted on at least one of a left or right side of the shield. In some embodiments, the hand shield is configured to function as a steadying device for a weapon held by a user of the hand shielding ballistic shield. In some embodiments, the ballistic shield includes a transparent insert or window. In some embodiments, the ballistic shield does not include a transparent insert (window) in the shield.

BRIEF DESCRIPTION OF THE DRAWINGS

Embodiments of the present disclosure are described by the way of example with references to the accompanying drawings, which are schematic and are not intended to be drawn to scale. The drawings referenced herein form a part of the specification. Features shown in the drawings are meant as illustrative of only some aspects of the invention.

DESCRIPTION

Figure 1:
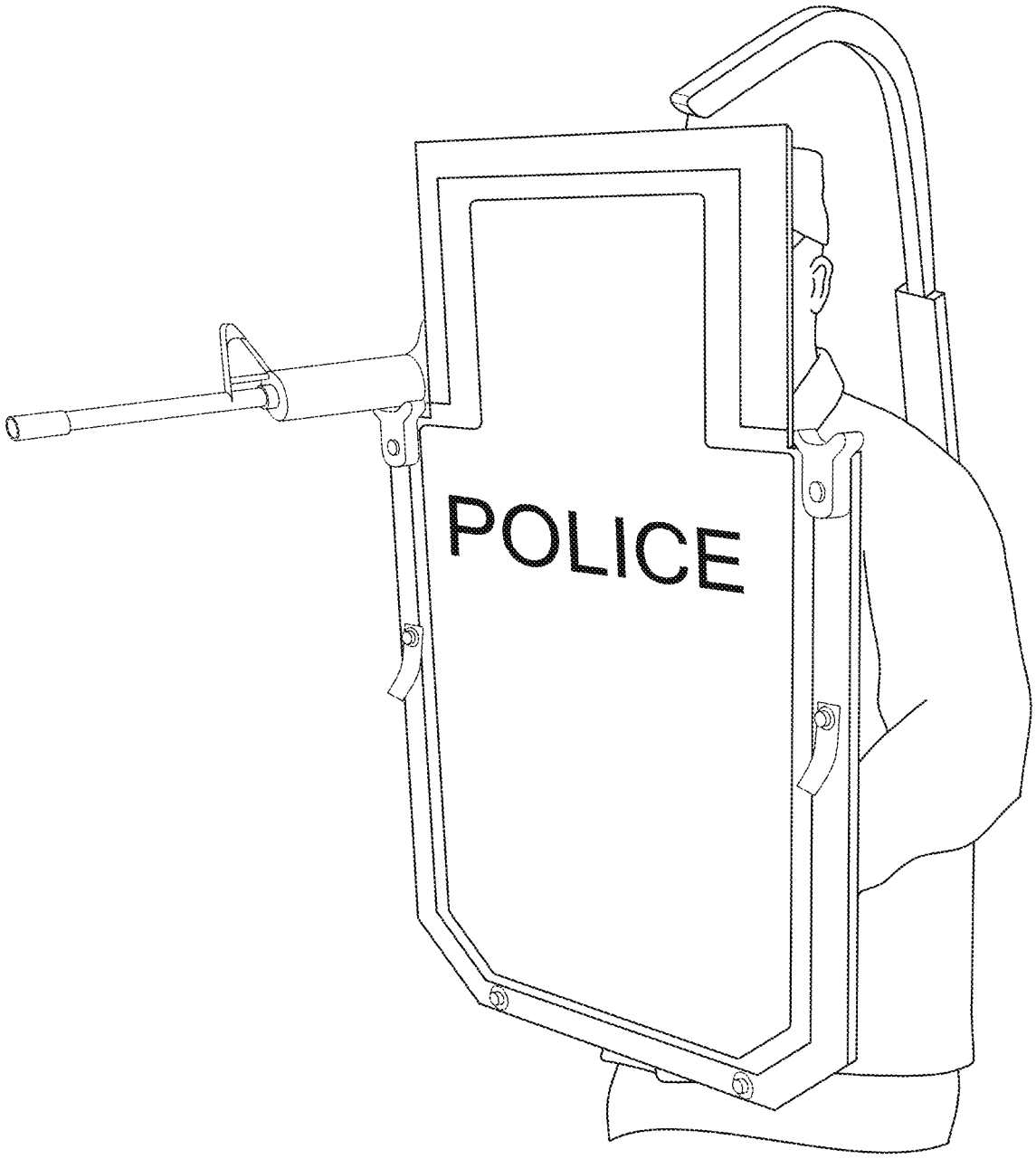
FIG. 1 PRIOR ART
FIG. 1 illustrates a conventional solid ballistic shield without a window in connection with the prior art.
Figure 2:
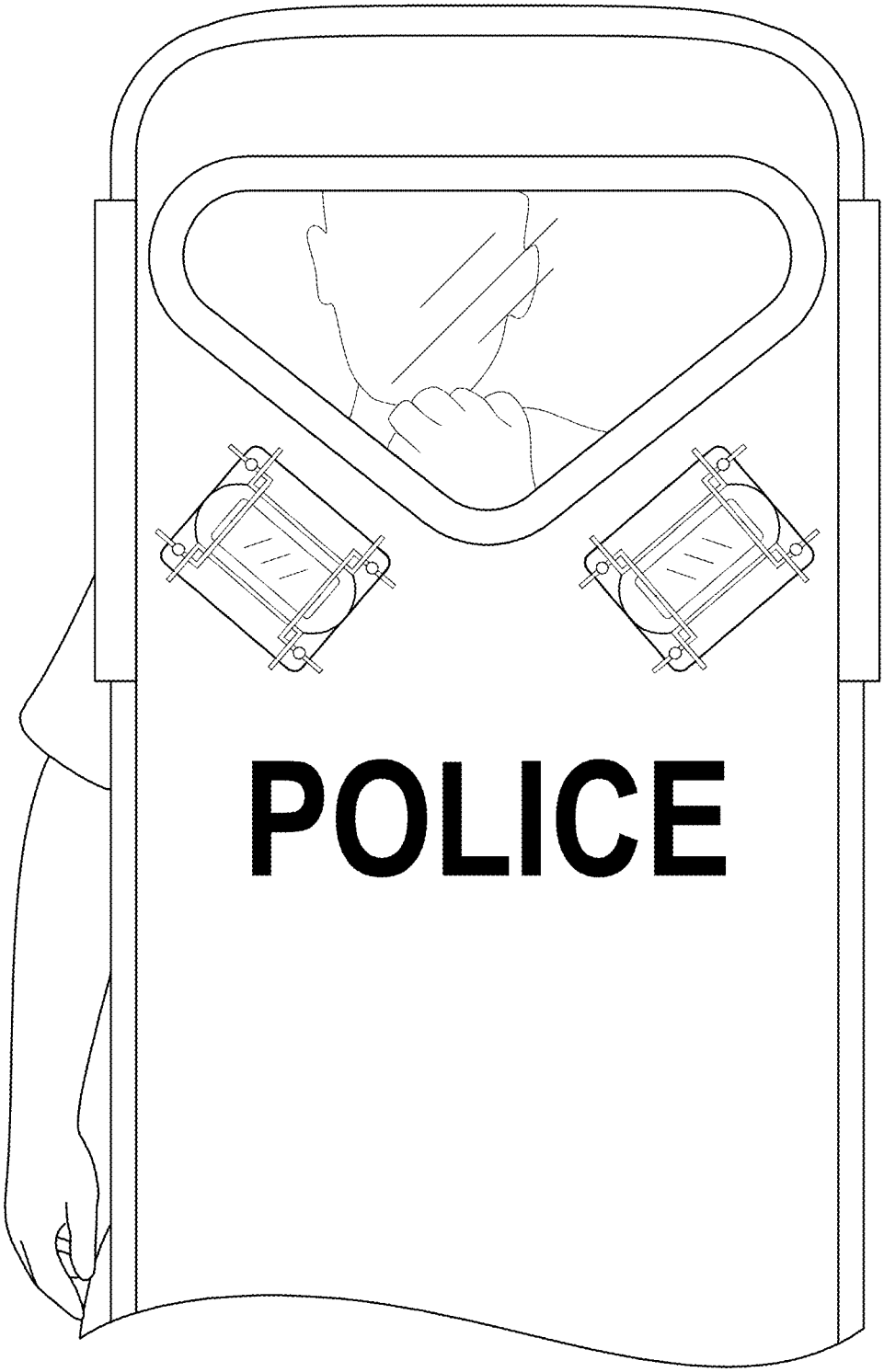
FIG. 2 PRIOR ART
FIG. 2 illustrates a conventional ballistic shield with a window in connection with the prior art.

In the following detailed description, reference is made in the accompanying drawings, which form a part hereof. The drawings are not to scale or to proportion and the illustrated embodiments described in the detailed description and claims are not meant to be limiting. Other embodiments may be used and/or and other changes may be made without departing from the spirit or scope of present invention.

As noted above, there is a need for providing safe, lightweight, low-cost visibility functionality in a ballistic handheld shield design. In addition to handheld shields, which are shown and described herein, in some embodiments ballistic shields having remote viewing scopes can be implemented in connection with any ballistic shield where remote safe viewing is desired. Such applications can include shields installed on or built into boats, vehicles, buildings, or any other vision-obscuring shield, whether the shield is naturally part of the structure or explicitly added or constructed for protective purposes.

Referring now to FIGS. 3A-3F, 4A-4D, and 5A-5D, remote viewing shields 30, 40, 50 are provided and can generally include a ballistic shield 31, 41 having one or more remote viewing scopes 300, 400, 500. The remote viewing shield 30, 40, 50 can preferably include a solid ballistic shield 31, 41 having a remote viewing scope 300, 400, 500 installed thereon and positioned to permit a user to look around an edge of the solid shield 31, 41 while the user's head remains behind (and therefore protected by) the solid shield 31, 41. As shown in FIGS. 3A-3F and 4A-4D, in some embodiments, the remote viewing shield 300, 400 can include the remote viewing scope 300, 400 mounted to a top edge of the solid shield 31, 41 to permit forward viewing from above the shield. As shown in FIGS. 5A-5D, in some embodiments the remote viewing scope 500 can instead be mounted to a left and/or right side edge of the solid shield 31 to permit forward viewing from a side of the shield (see also FIGS. 6A-6C, and 7A-7C). In other embodiments (not shown), the remote viewing scope can be mounted to a bottom edge of the solid shield to permit forward viewing from below the shield. In other embodiments, a combination of top, side, and/or bottom mounted remote viewing scopes 300, 400, 500 can be used (see FIGS. 9A-9B).

As shown in FIGS. 3A-3F, a top mount configuration can provide a view over the top of the solid shield 31. The top mount remote viewing shield 300 of FIGS. 3A-3F includes the solid shield 31 and the top mount remote viewing scope 300. A handle 33 can also be provided to facilitate carrying of the shield by a user. At its most basic, the remote viewing scope 300 can be any optical device capable of providing imagery of a user's obscured field of view. The top mount configuration can be advantageous in that it can provide a more expansive field of view by virtue of being higher above the ground.

In some embodiments, the top mount remote viewing scope 300 can be a periscope configuration as shown. The periscope can generally include a first end extending above, below, or to a side of the ballistic shield for redirecting imagery of threat to a second end positioned behind the ballistic shield for viewing by a user protected by the shield. Still referring to FIGS. 3A-3F, in some embodiments the remote viewing scope can include a threat-side mirror 301 angled to redirect an image through a tube 303 to a viewing mirror 305 angled to redirect the image so as to be viewable by a user positioned behind the solid shield. Although shown to be a basic mirror periscope, it should be noted that, in some embodiments, any style of periscope can be used including, for example, mirror periscopes, prism periscopes, lens periscopes, or combinations thereof. As shown, both mirrors 301, 305 are generally at 45 degrees to the normal of the mounting surface, and parallel with each other. Looking at the viewing mirror 305, the effect is that it looks like a window, and gives the user a clear view of the threat. However, it will be apparent in view of this disclosure that any arrangement of mirrors at any combination of angles can be used in accordance with various embodiments.

In some embodiments, because mirrors provide broad spectrum reflectivity, use of a mirror periscope advantageously provides seamless compatibility with vision aids by the user of the remote viewing shield. Such viewing aids can include, for example, goggles, binoculars, scopes, and the like, whether configured for magnification, night vision, infrared sensing, other non-visible spectrum sensing, or combinations thereof.

In some embodiments, the threat-side mirror 301 and/or the remote viewing scope 300 more generally can be constructed for ballistic resistance, similar to the solid shield. Alternatively, in some embodiments, the threat-side mirror 301 and/or the remote viewing scope 300 can be ballistically fragile to permit ballistic projectiles to pass therethrough without ricochet. By avoiding ricochet, such fragile configurations can advantageously avoid redirection of the ballistic projectile into the user, thereby preserving the protection provided by the solid shield. In addition, fragile configurations are not susceptible to spiderweb cracking, which obscures ballistic glass after impact, rendering the remote viewing scope unusable. The fragile remote viewing scope instead permits the projectile to pass through, leaving only a small hole in the field of view, preserving continued functionality of the remote viewing scope.

Figure 3A:
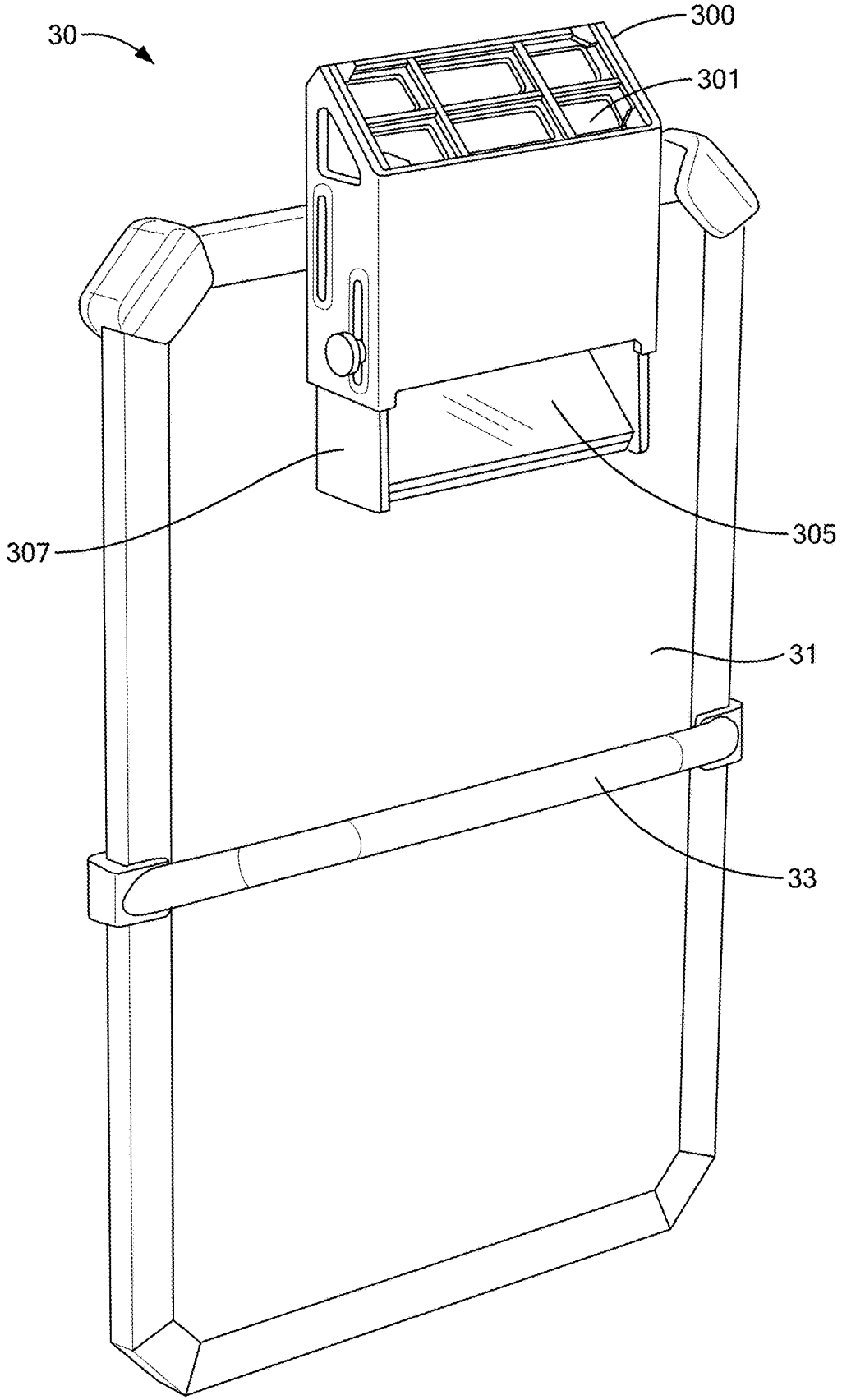
FIG. 3A illustrates a rear perspective view of a solid ballistic shield having a top mount remote viewing scope.
Figure 3B:
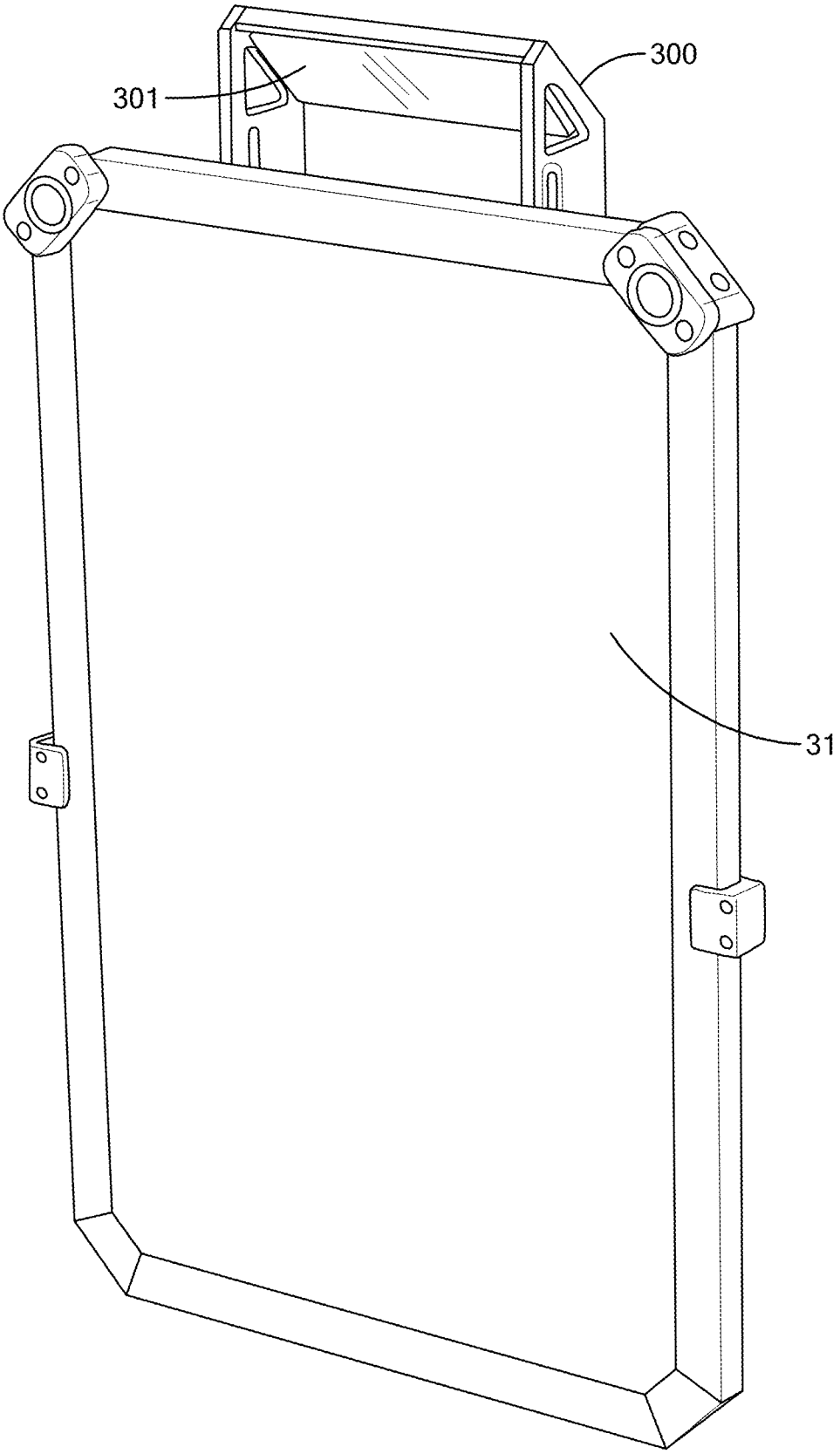
FIG. 3B illustrates a front perspective view of the solid ballistic shield having the top mount remote viewing scope of FIG. 3A.
Figure 3D:
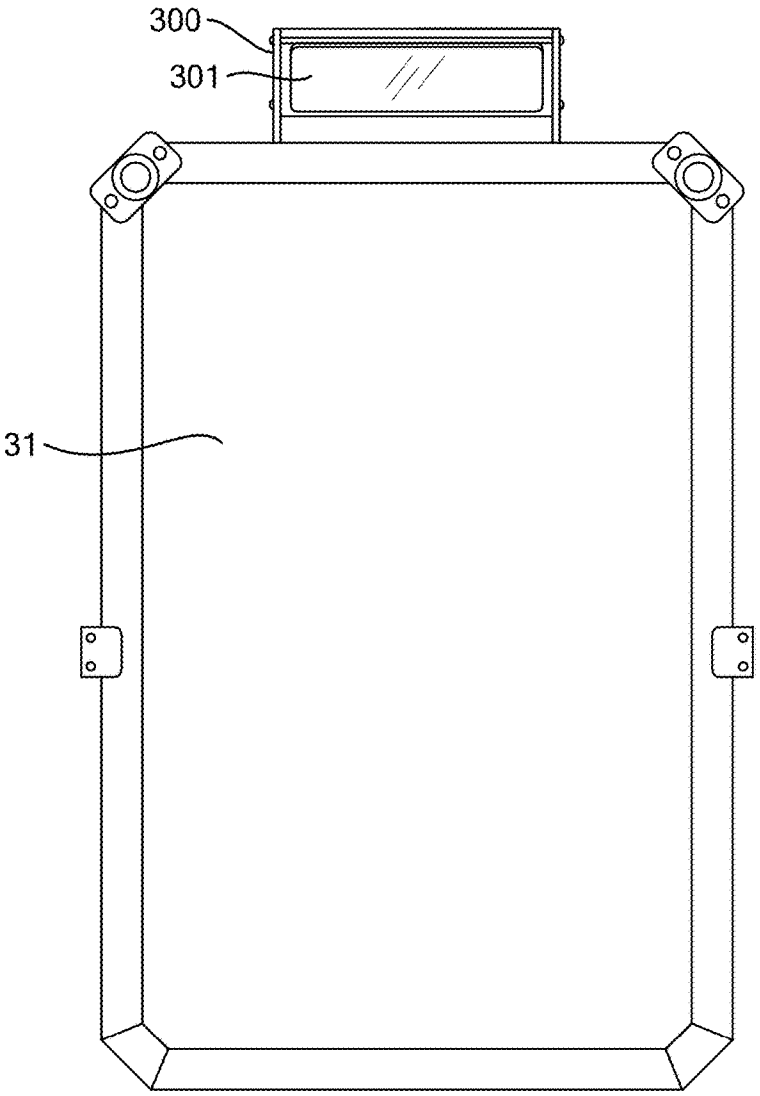
FIG. 3D illustrates a front elevation view of the solid ballistic shield having the top mount remote viewing scope of FIG. 3A.
Figure 3C:
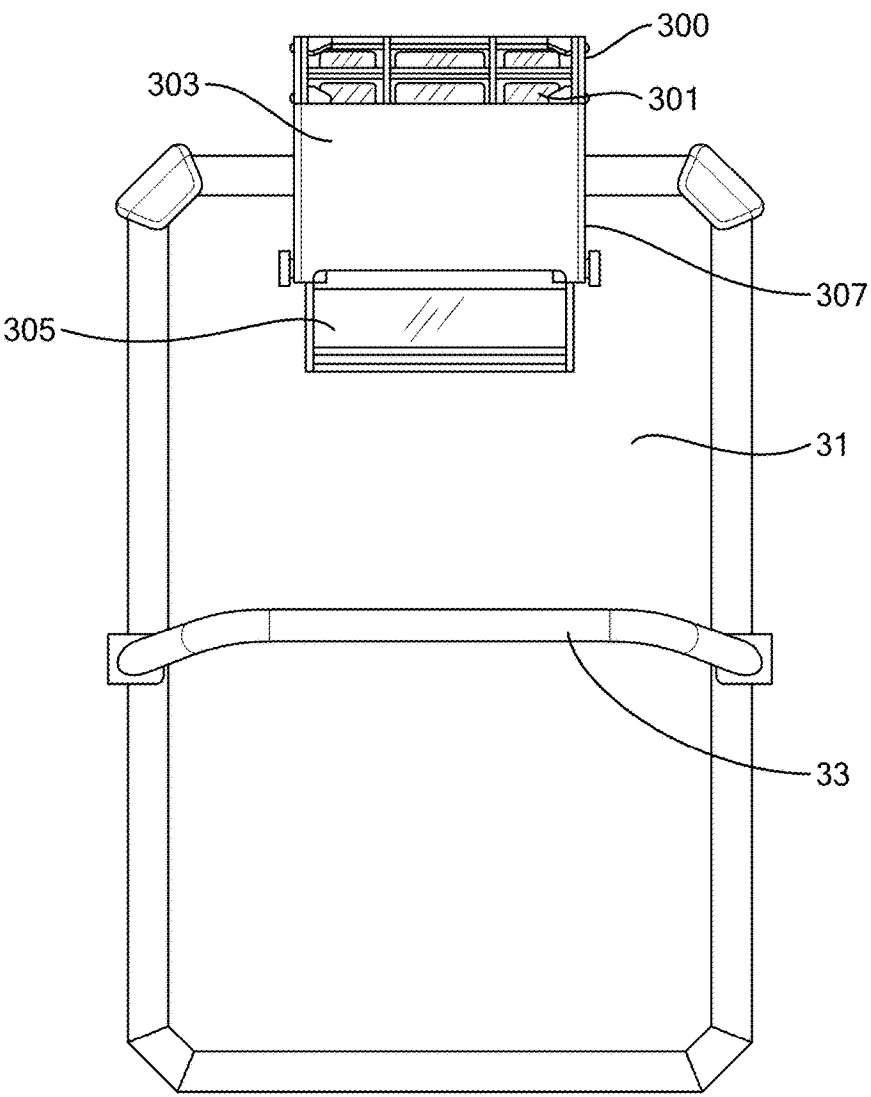
FIG. 3C illustrates a rear elevation view of the solid ballistic shield having the top mount remote viewing scope of FIG. 3A.
Figure 3E:
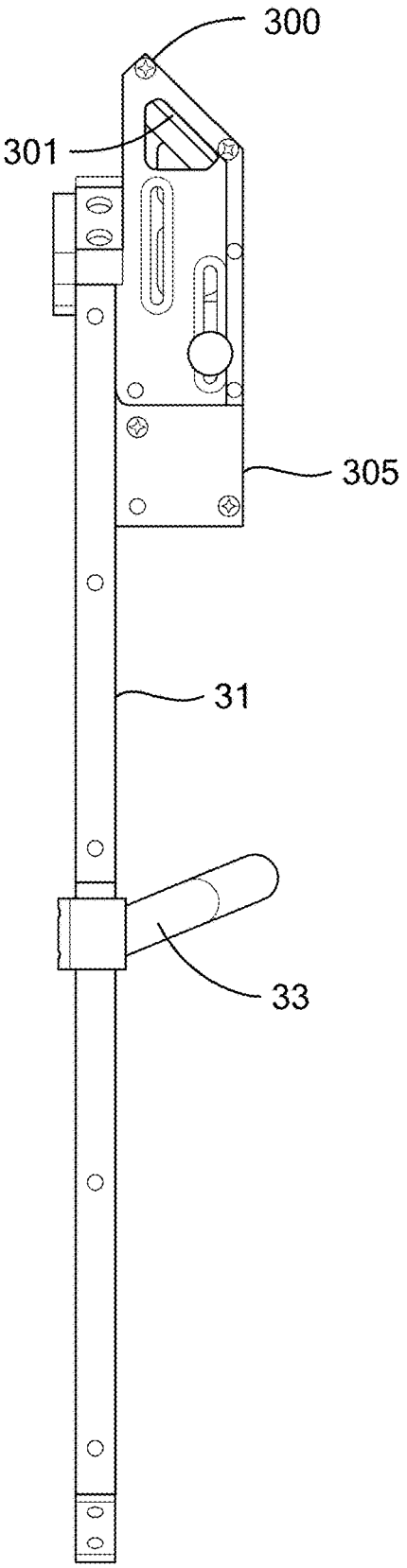
FIG. 3E illustrates a right side elevation view of the solid ballistic shield having the top mount remote viewing scope of FIG. 3A.
Figure 3F:
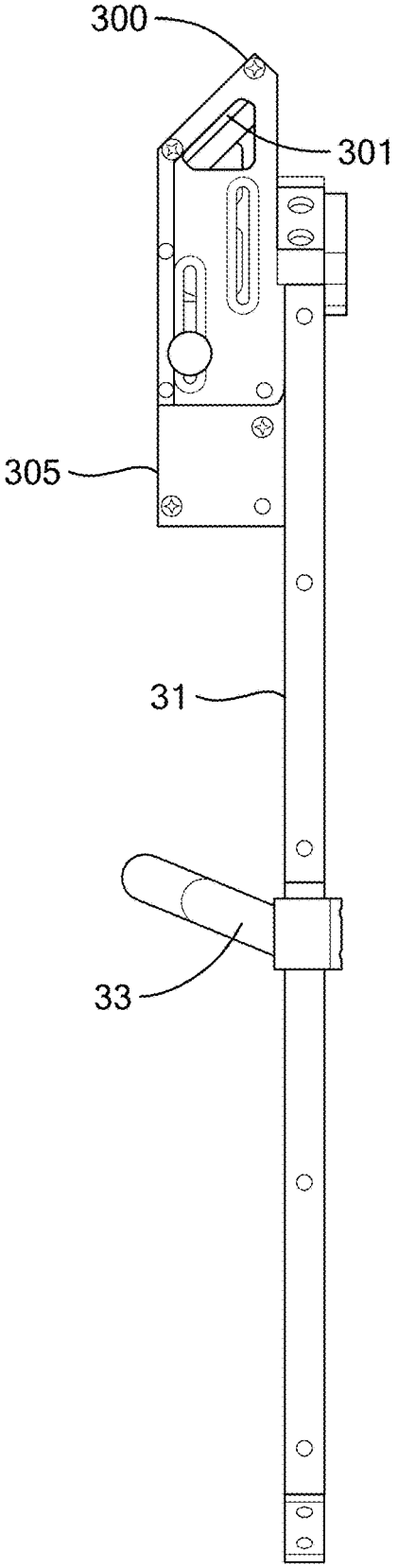
FIG. 3F illustrates a left side elevation view of the solid ballistic shield having a top mount remote viewing scope of FIG. 3A.
Figure 4B:
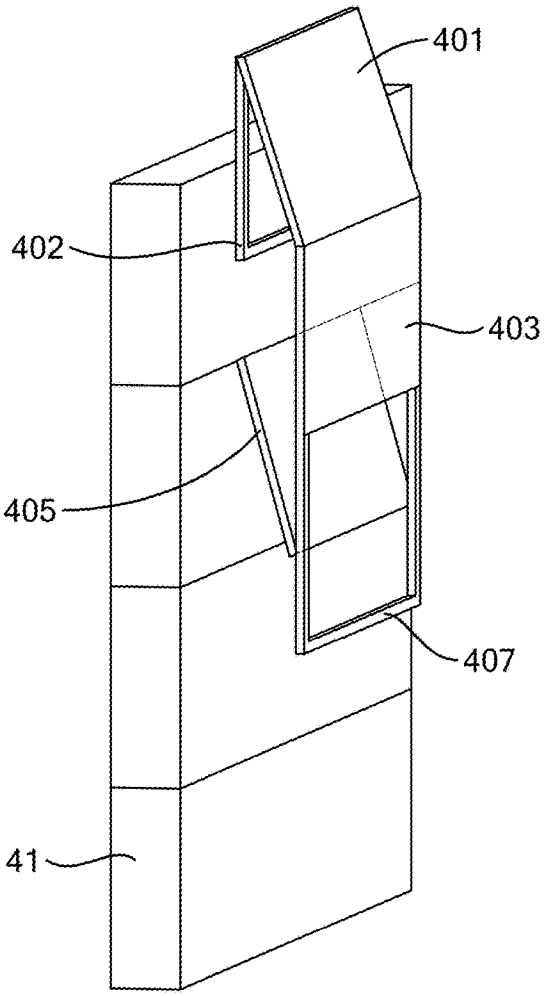
FIGS. 4A-4D illustrate rear perspective views of a solid ballistic shield having a foldable top mount remote viewing scope in different states of deployment.
Figure 4A:
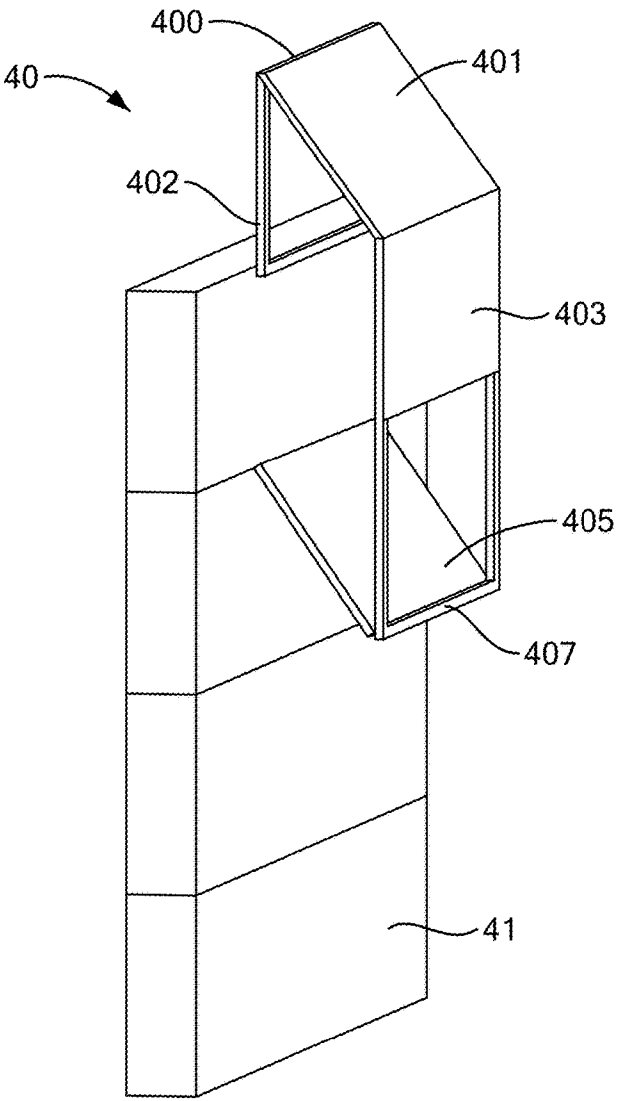
Figure 4D:
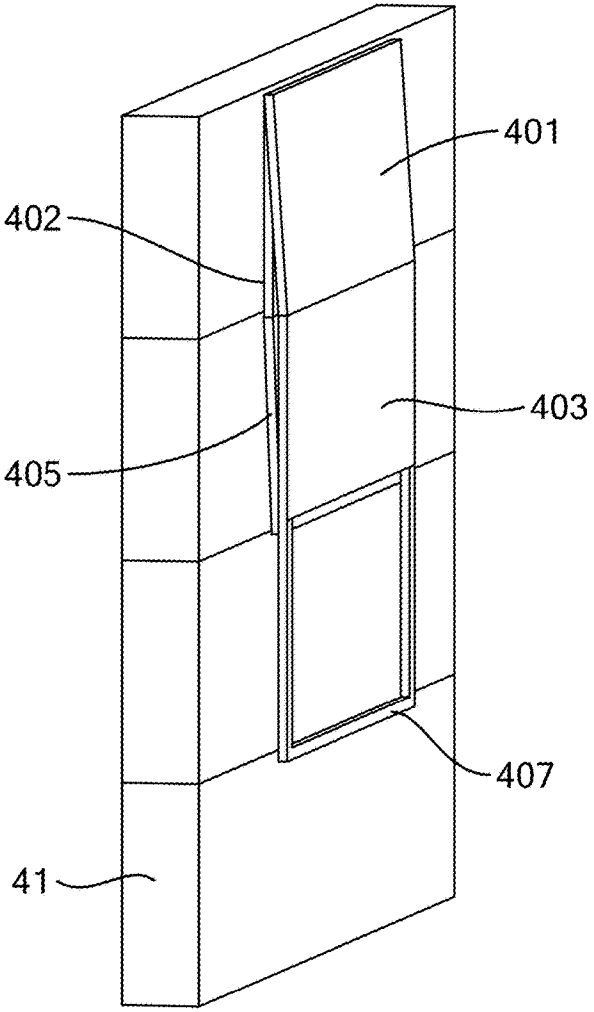
Figure 4C:
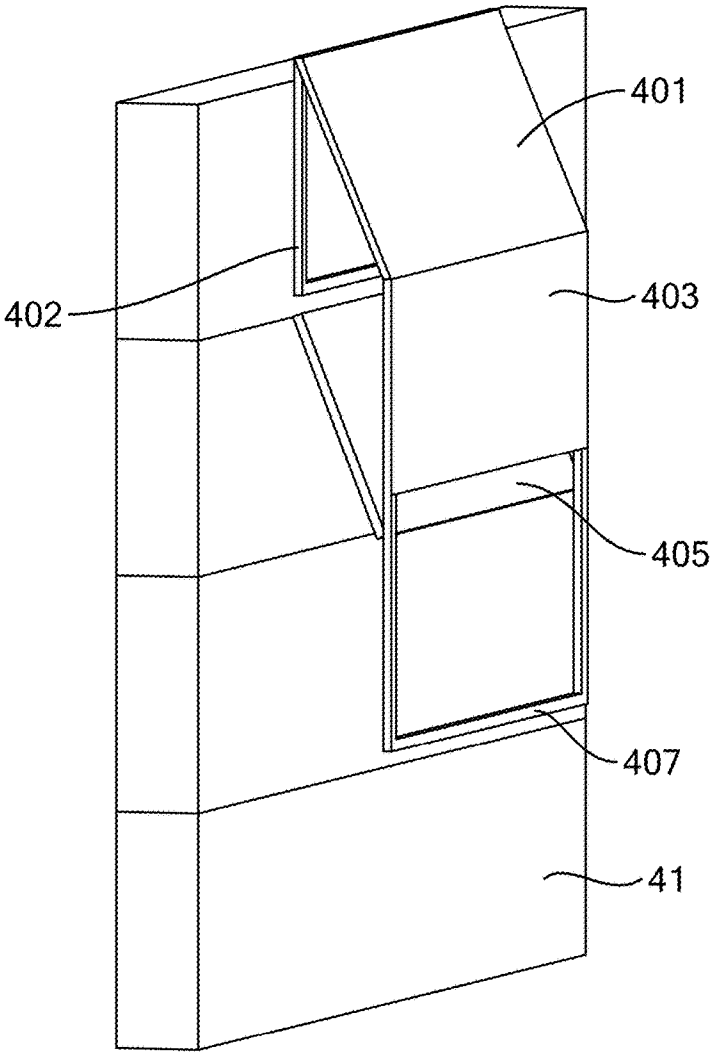
Figure 5B:
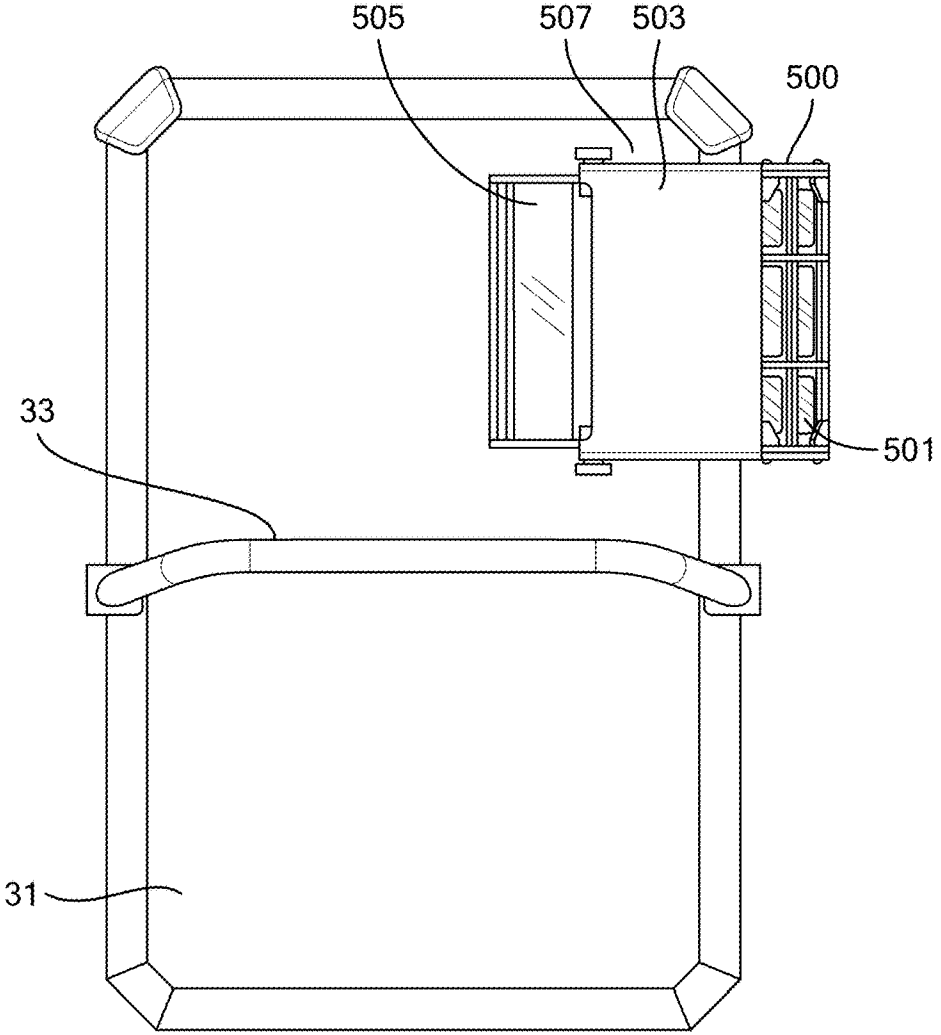
FIG. 5B illustrates a rear elevation view of the solid ballistic shield having the side mount remote viewing scope of FIG. 5A.
Figure 5A:
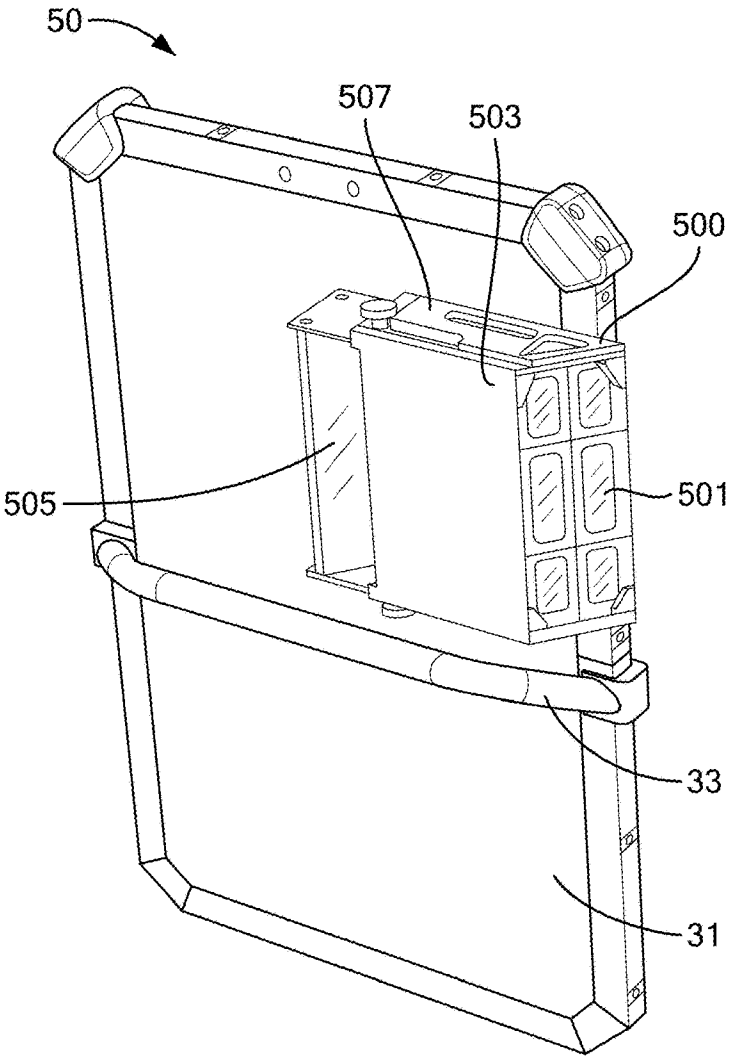
FIG. 5A illustrates a rear elevation view of a solid ballistic shield having a side mount remote viewing scope.
Figure 5D:
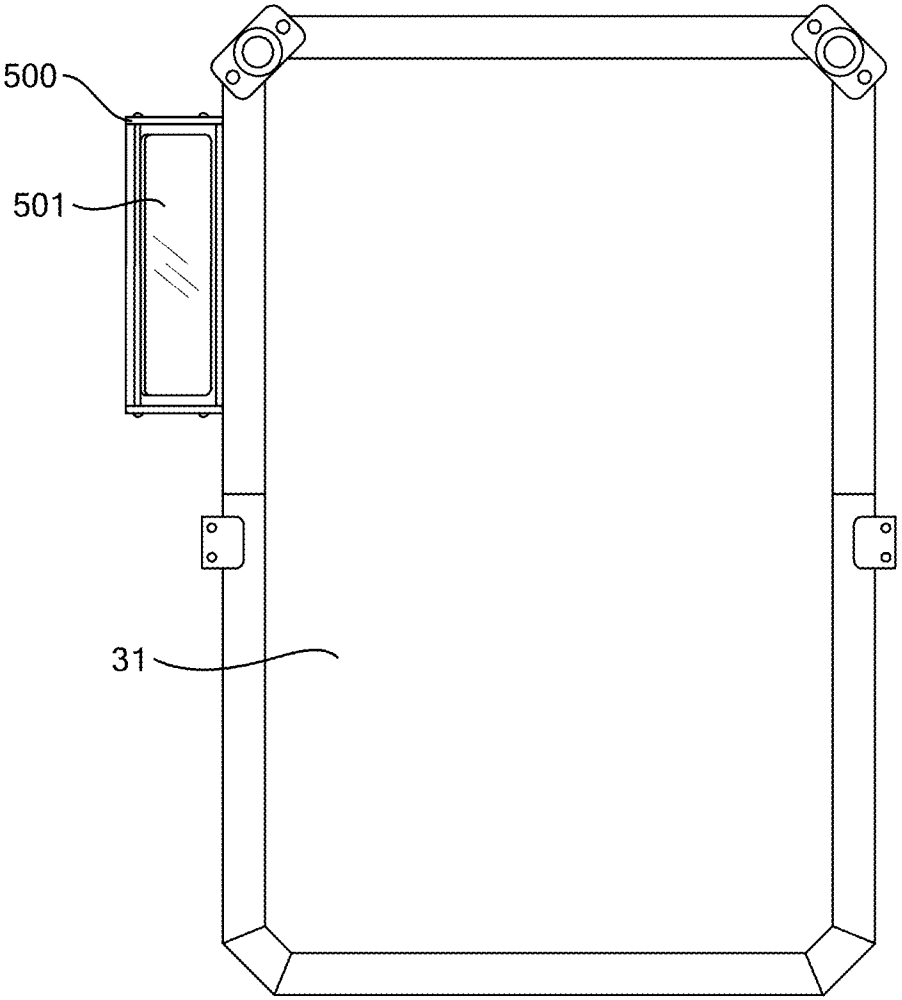
FIG. 5D illustrates a front elevation view of the solid ballistic shield having the side mount remote viewing scope of FIG. 5A.
Figure 5C:
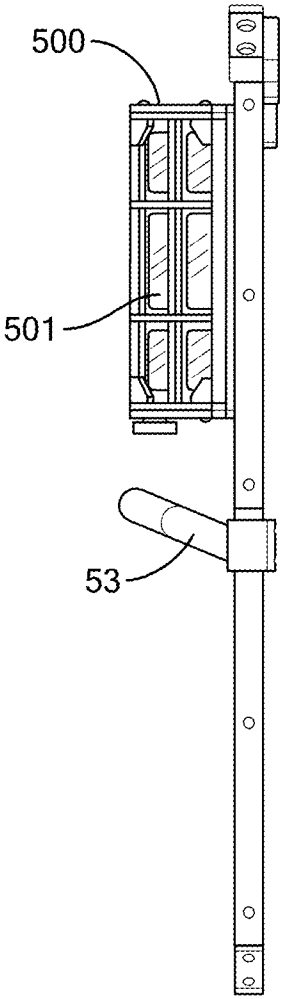
FIG. 5C illustrates a right side elevation view of the solid ballistic shield having the side mount remote viewing scope of FIG. 5A.

In some embodiments, as shown, for example, in FIG. 3A, the top mount remote viewing scope 300 can be mounted in a sliding bracket 307 to permit the tube 303 to slide between a retracted position, preferably fully behind the solid ballistic shield 31, to a fully extended viewing position, wherein the threat-side mirror 301 is positioned for providing an image to the user via the viewing mirror. Thus, the assembly can slide down, into the stowed mode, where the mirrors are protected from damage and contamination.

Alternatively, referring now to FIGS. 4A-4D, in some embodiments the remote viewing scope 400 may fold flat behind the shield, and slide down to stow in a folded position, thereby protecting the mirrors while not in use. As shown, such a foldable configuration can include a viewing mirror 405 hingedly attached to the solid shield 41 and both hingedly and slidably attached to a viewing support 407, a tube panel 403 hingedly attached to the viewing support 407, a threat-side mirror 401 hingedly attached to both the tube panel 403 and a threat-side support 402, and the threat-side support slidably attached to the solid shield. In use, the remote viewing scope can be stowed from a deployed position (shown in FIG. 4A) by sliding the threat-side support 402 and the viewing support 407 down relative to the solid shield and the viewing mirror 405 (shown in FIGS. 4B and 4C) to move the foldable remote viewing scope 400 behind the solid shield 41, and then folding the threat side-mirror 401 against and parallel to the threat-side support 402 and folding the viewing mirror 405 against and parallel to the solid shield 41 to minimize a profile of the foldable remote viewing scope 400.

As shown in FIGS. 5A-5D, a side mount design is generally the same as the top mount design with the exception that the side mount remote viewing scope 500 is positioned to provide visibility around either the right or left side of the solid shield, depending on mounting (e.g., right side as shown). Left or right mounting largely depends on the situation and/or user preference. The basic components (e.g., remote viewing scope 500, sliding bracket 507, tube 503, viewing mirror 505, threat-side mirror 501, handle 33, and solid shield 31) are otherwise similar to the top mount design of FIGS. 3A-3F. One advantage of the side mount configuration is that it can facilitate visibility around corners without exposing the solid shield or the user to any threats that may be positioned around the corner.

Figure 6B:
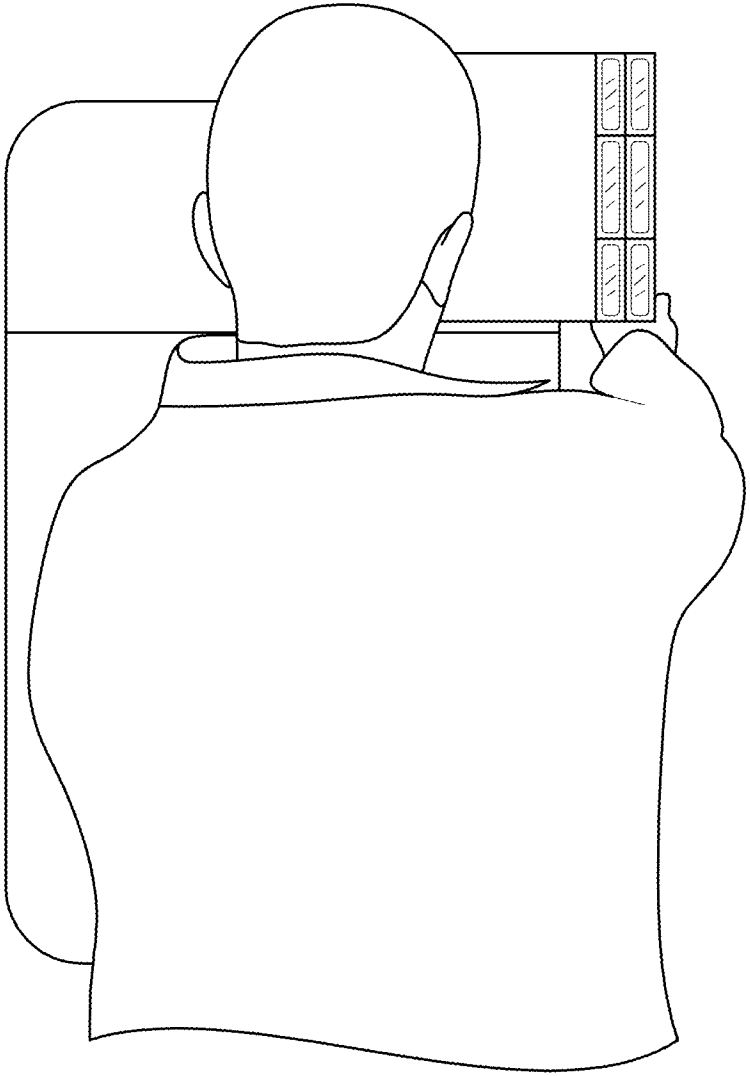
FIG. 6B illustrates a rear view of a user holding the solid ballistic shield having the side mount remote viewing scope of FIG. 5A in a protective stance.
Figure 6A:
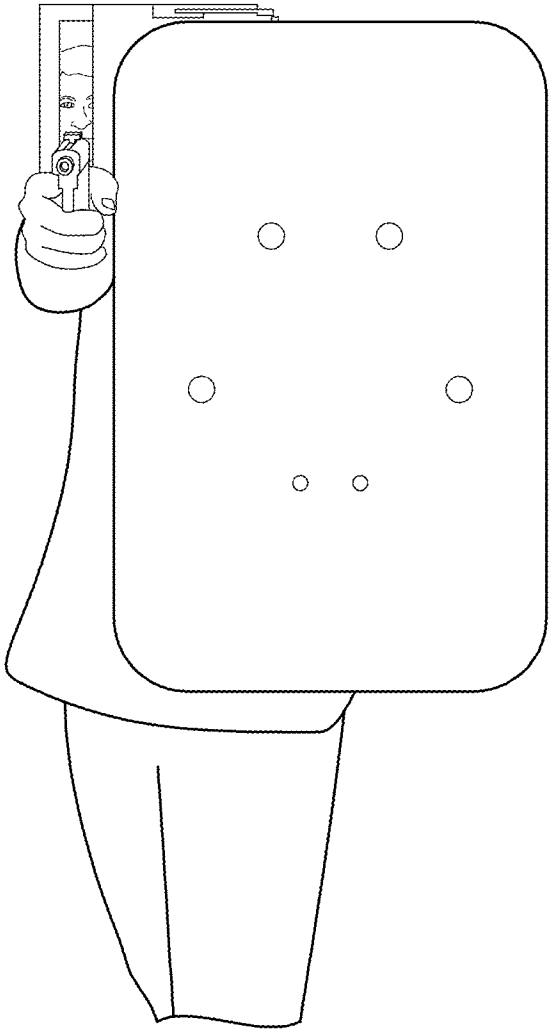
FIG. 6A illustrates a front view of a user holding the solid ballistic shield having the side mount remote viewing scope of FIG. 5A in a tactical stance.
Figure 6C:
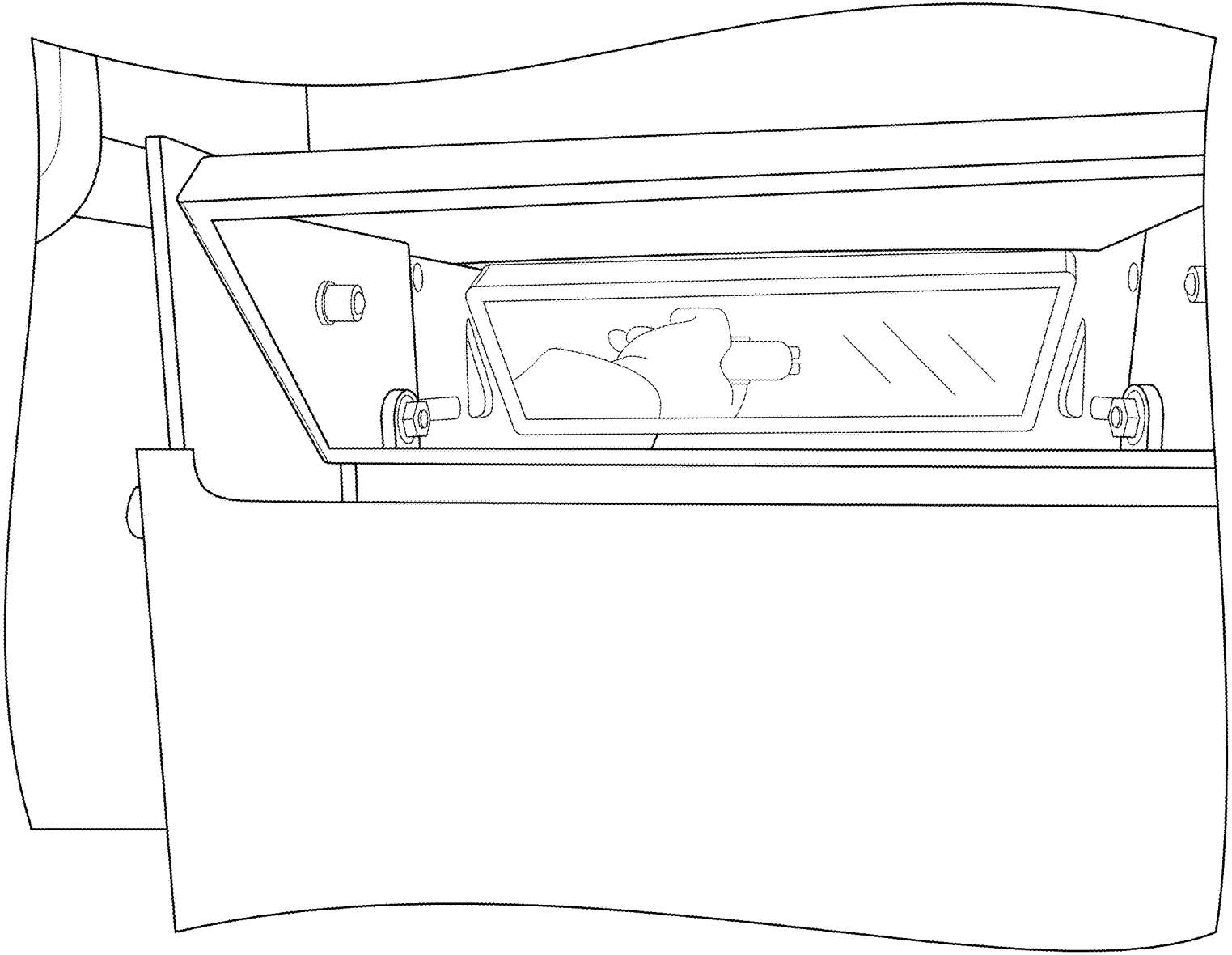
FIG. 6C illustrates a tactical view through a viewing mirror of the solid ballistic shield having the side mount remote viewing scope of FIG. 5A.

In addition, as shown in FIGS. 6A-6C the side-mount can more easily align the user's field of view with a side-arm or other weapon being held by the user, thereby permitting the user to better aim at a target threat when discharging the weapon. More specifically, side mount can aid in aiming a weapon by placing the user's right arm along the side of the shield, and under the Shield-Scope so that the sights of the weapon are visible in the viewing mirror. In particular, FIG. 6A shows a front view of the side mount shield, showing the user with a defensive weapon held under the threat side of the remote viewing scope. FIG. 6B shows a rear view of the side mount shield wherein the user's hand and weapon are under the threat end of the remote viewing scope, while the user looks into the protected viewing end of the remote viewing scope. FIG. 6C shows a rear view of the viewing port (protected end of the scope) with defensive weapon drawn, using the viewport for aiming the weapon.

Figure 7A:
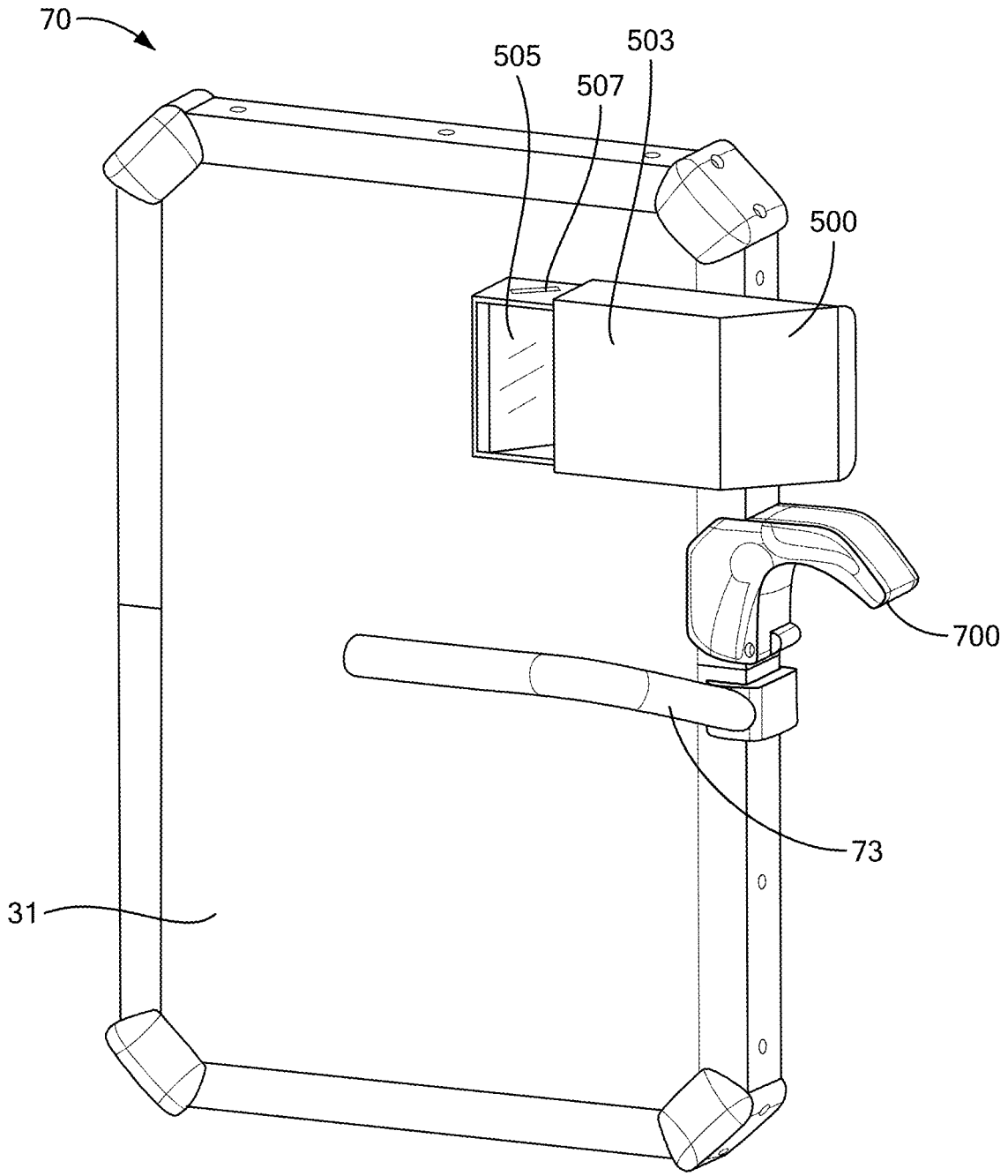
FIG. 7A illustrates a rear perspective view of a solid ballistic shield having a side mount remote viewing scope and forearm support.
Figure 7B:
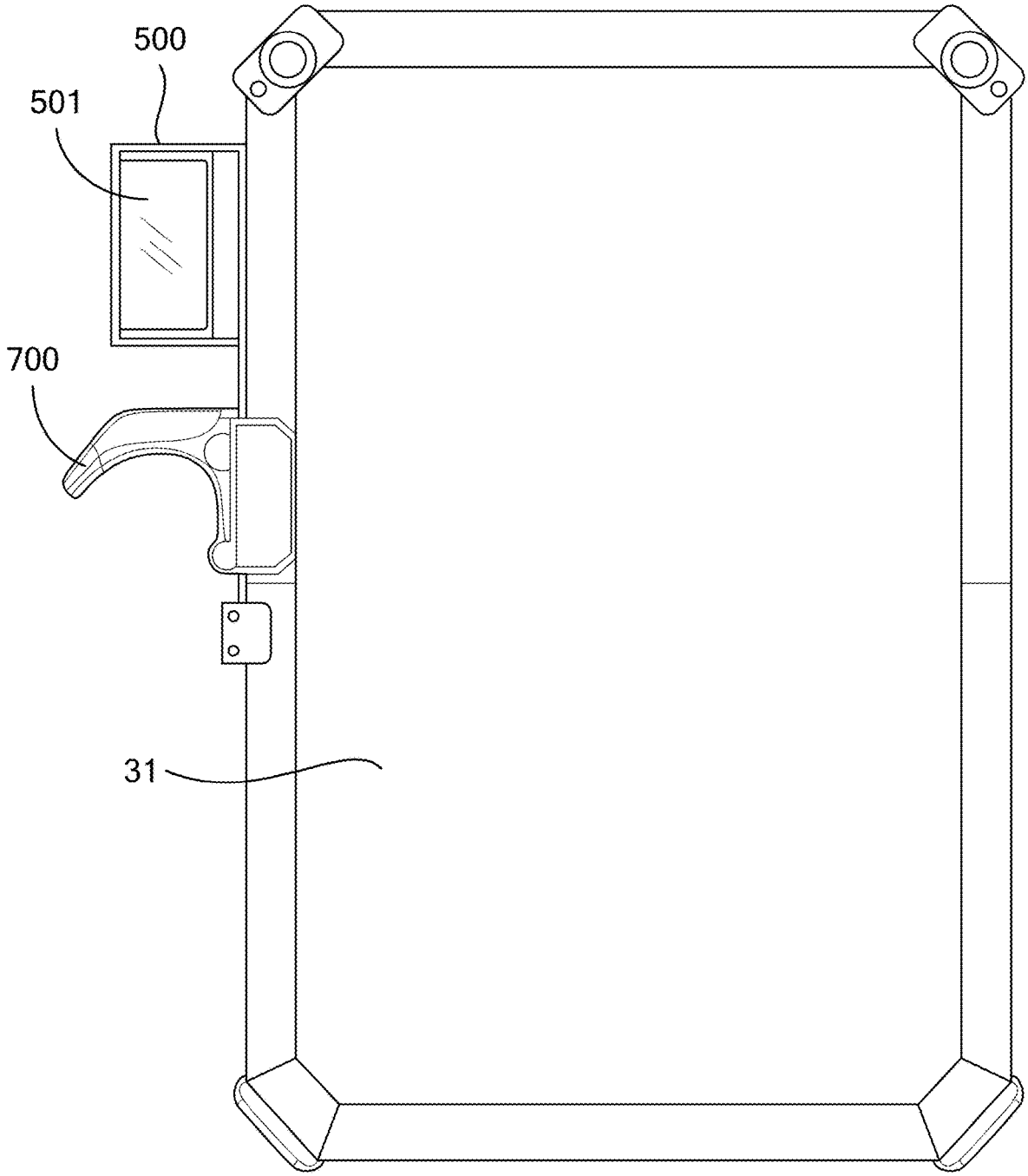
FIG. 7B illustrates a front elevation view of the solid ballistic shield having the side mount remote viewing scope and forearm support of FIG. 7A.
Figure 7C:
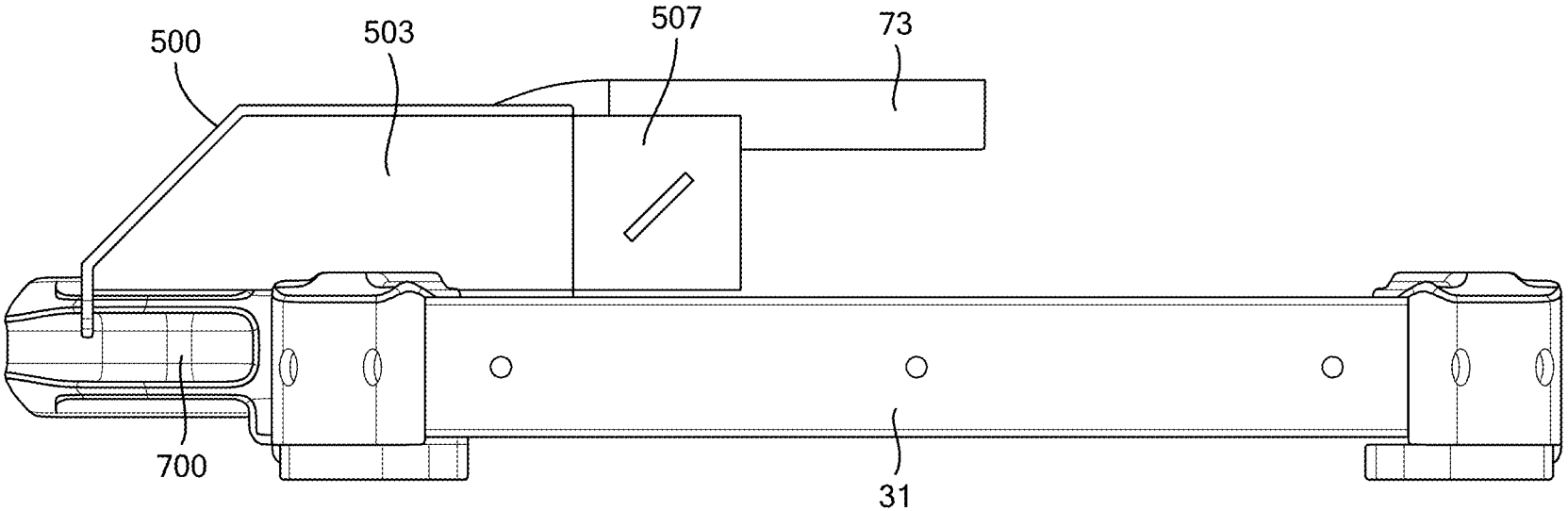
FIG. 7C illustrates a right side elevation view of the solid ballistic shield having the side mount remote viewing scope and forearm support of FIG. 7A.
Figure 8A:
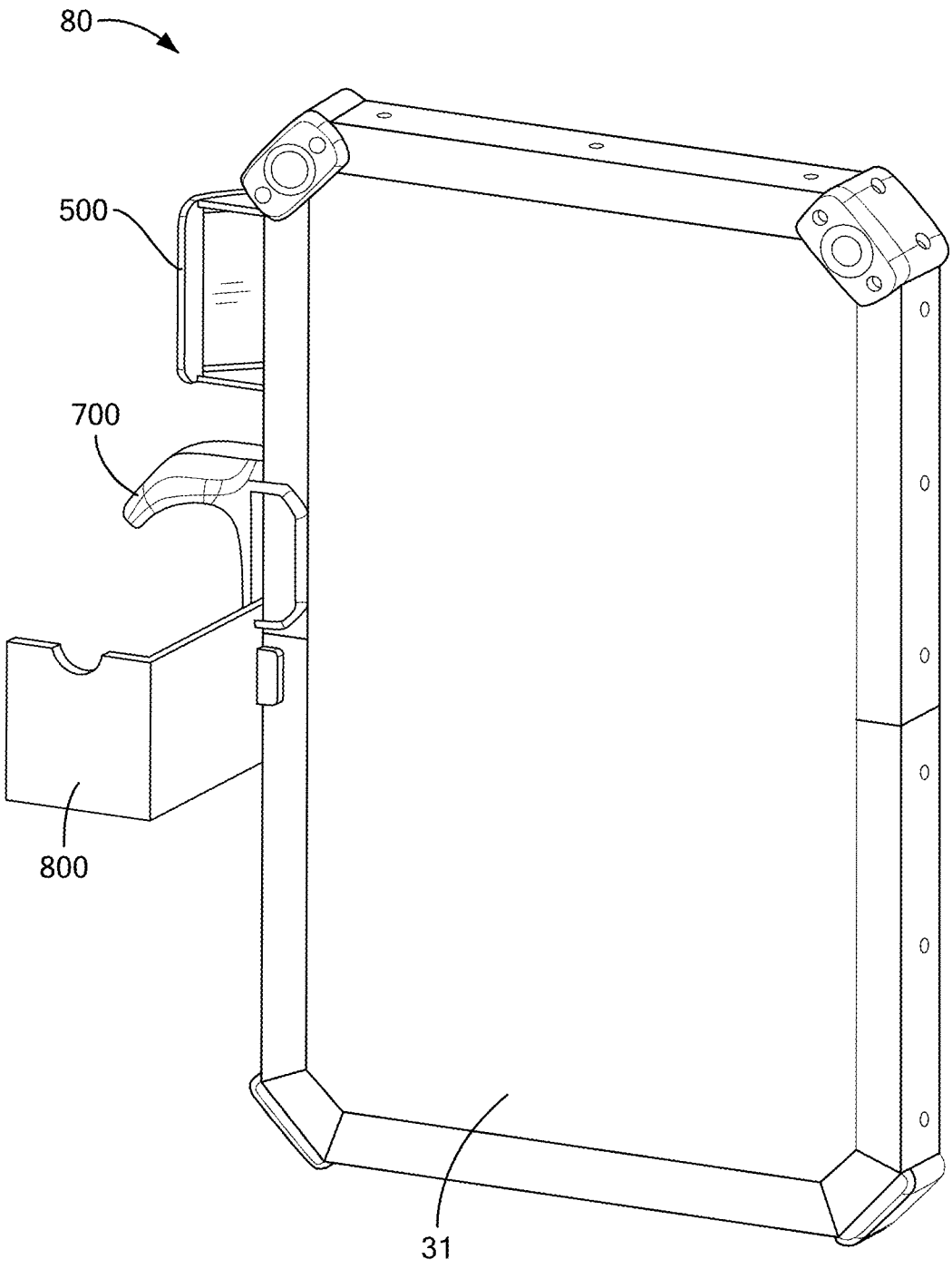
FIGS. 8A-8B illustrate front perspective views of the solid ballistic shield having the side mount remote viewing scope and forearm support of FIG. 7A having a hand shield also attached thereto.
Figure 8B:
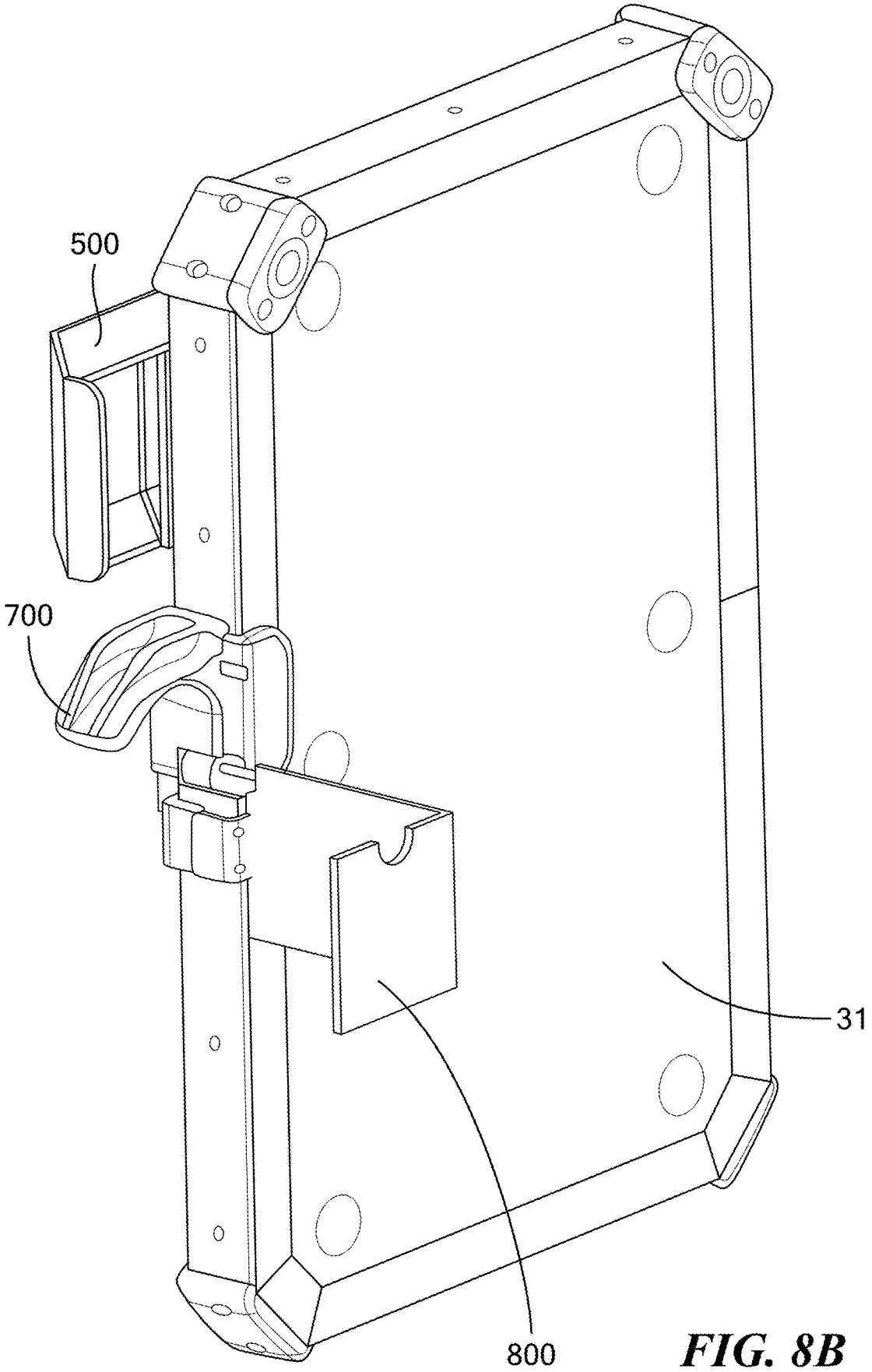

In some embodiments, as shown in FIGS. 7A-7C, the remote viewing shield 70 can be provided with a forearm support 700 for additional stability of the remote viewing shield 70. Such forearm supports 700 can be useful, for example, when one of the user's arms is holding a weapon as in FIGS. 6A-6C so that the user does not need to support the entire shield with only a single hand. In addition, as shown in FIGS. 8A-8B, in some embodiments, the remote viewing shield 80 can include a hand shield 800, constructed of ballistic material, in order to protect the user's hand and/or provide a rest for a defensive weapon held by the user to avoid fatigue.

In some embodiments (not shown), a bottom mount configuration can be used to look under the bottom of the shield. Such embodiments are useful in that a threat is unlikely to watch the bottom of the shield and, similarly, is unlikely to aim at the bottom of the shield. Therefore, the user is less likely to lose visibility and the user's eyes and reactions are less likely to be observed by the threat.

Figure 9A:
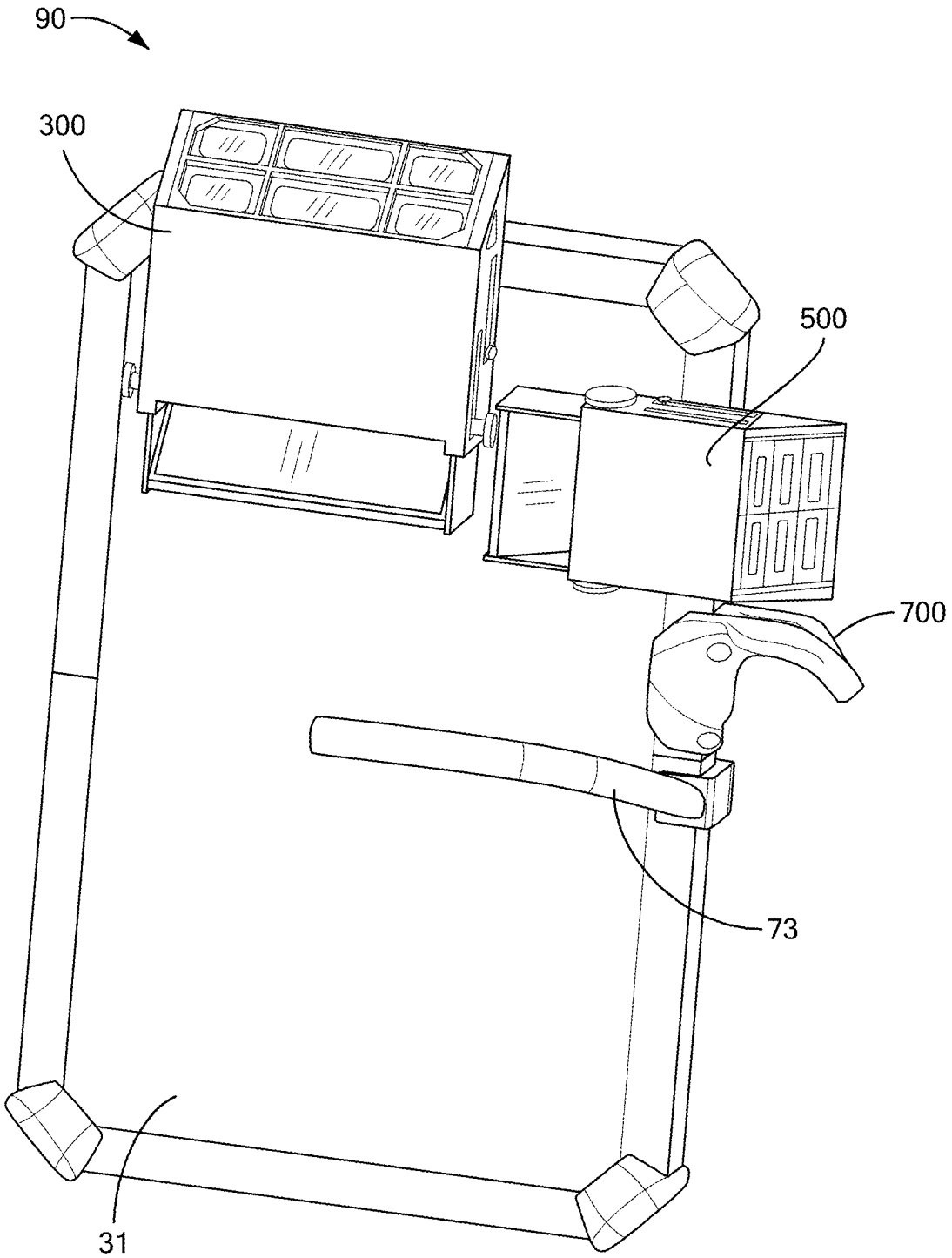
FIG. 9A illustrates a rear perspective view of a solid ballistic shield having both top and side mount remote viewing scopes.
Figure 9B:
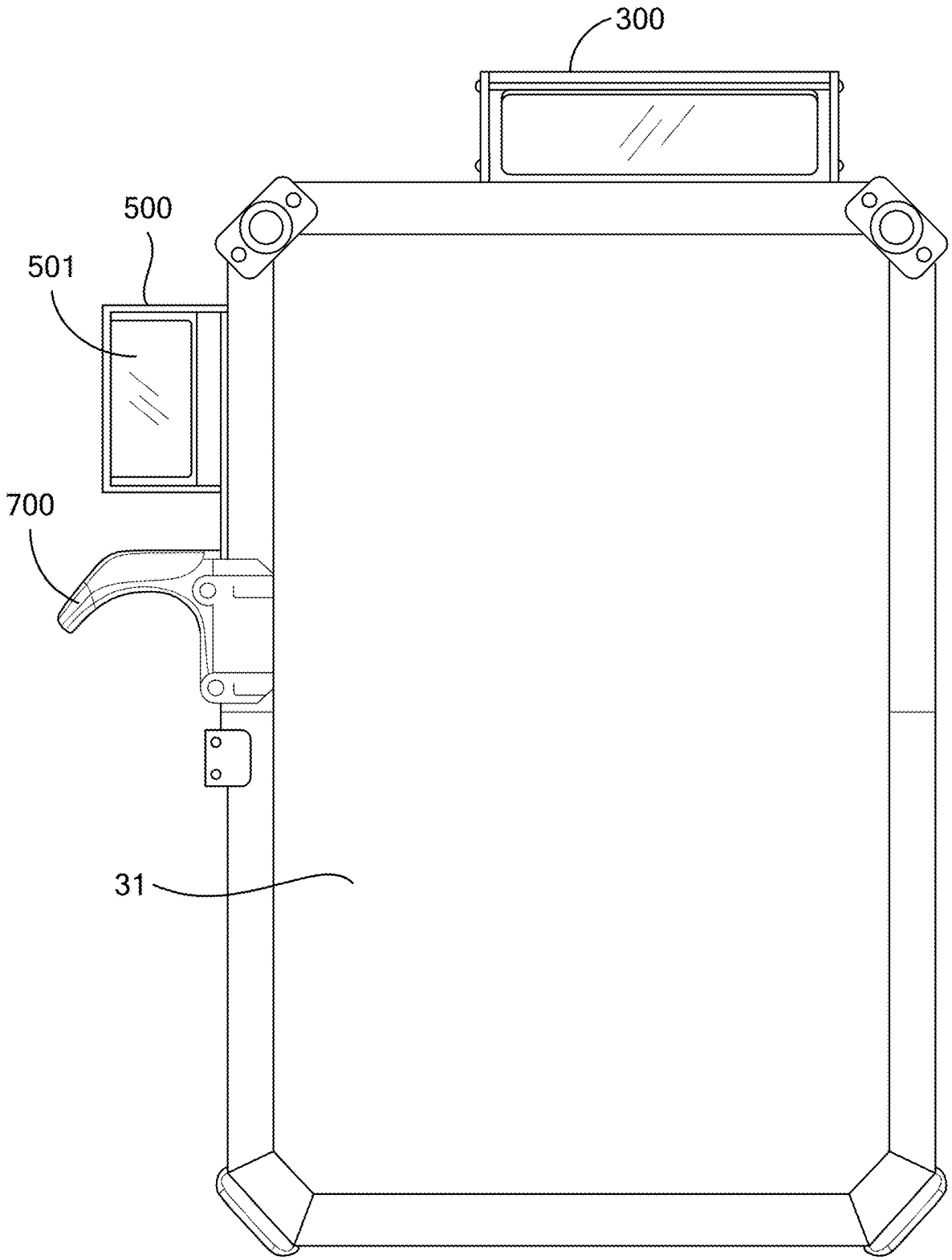
FIG. 9B illustrates a front elevation view of a solid ballistic shield having both top and side mount remote viewing scopes of FIG. 9A.
Figure 10A:
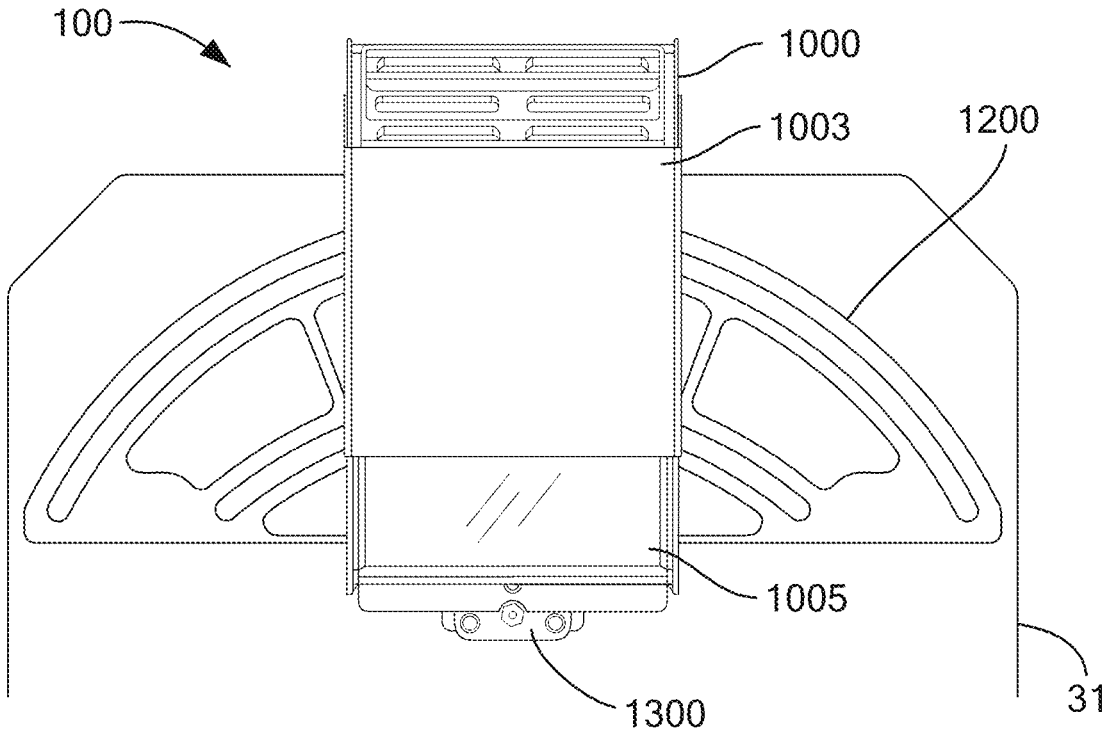
FIG. 10A illustrates a rear elevation view of a solid ballistic shield having a repositionable remote viewing scope, wherein the repositionable remove viewing scope is in a top view position.
Figure 10B:
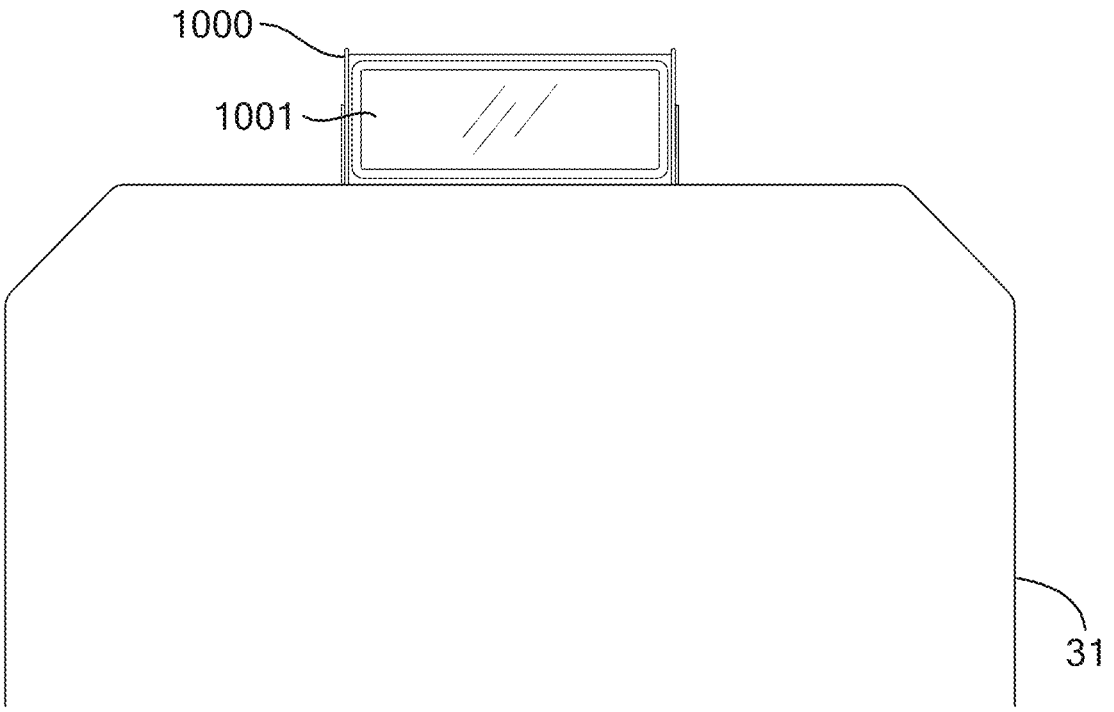
FIG. 10B illustrates a front elevation view of the solid ballistic shield having the repositionable remote viewing scope of FIG. 10A, wherein the repositionable remote viewing scope is in a top view position.
Figure 10C:
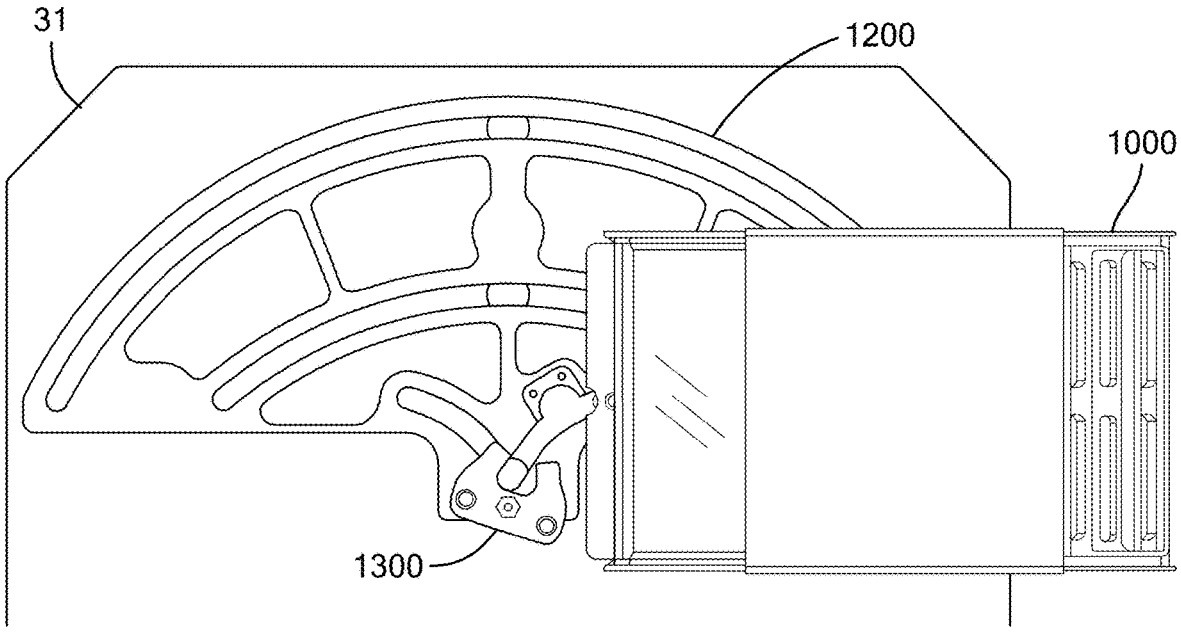
FIG. 10C illustrates a rear elevation view of the solid ballistic shield having the repositionable remote viewing scope of FIG. 10A, wherein the repositionable remote viewing scope is in a right side view position.
Figure 10D:
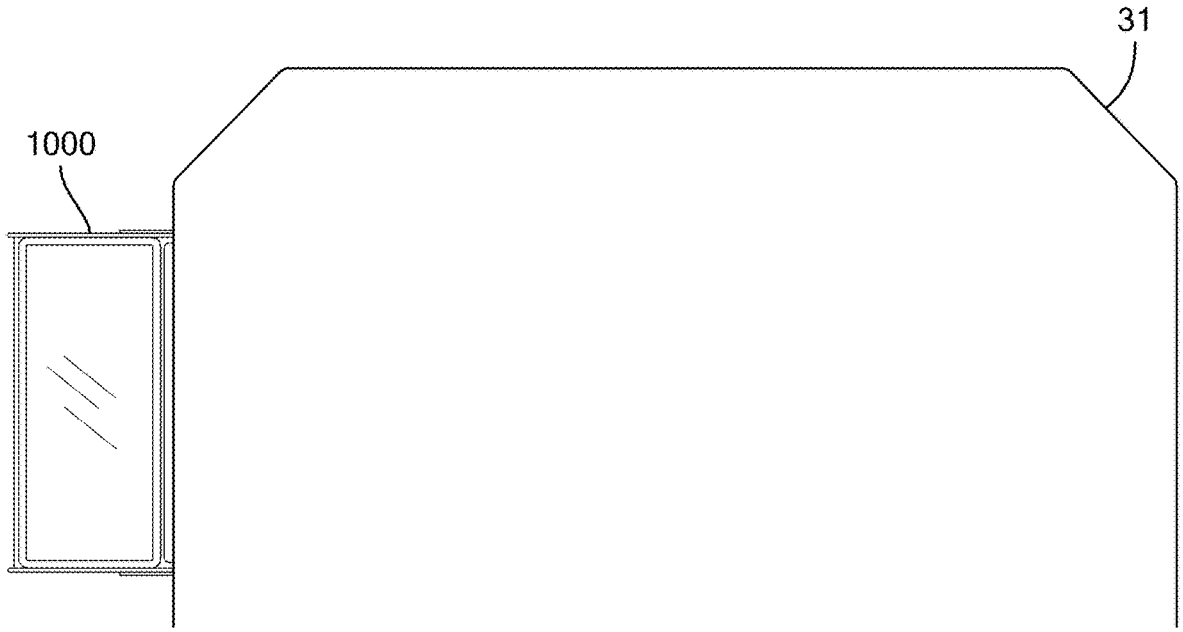
FIG. 10D illustrates a front elevation view of the solid ballistic shield having the repositionable remote viewing scope in the right side view position of FIG. 10C.
Figure 10E:
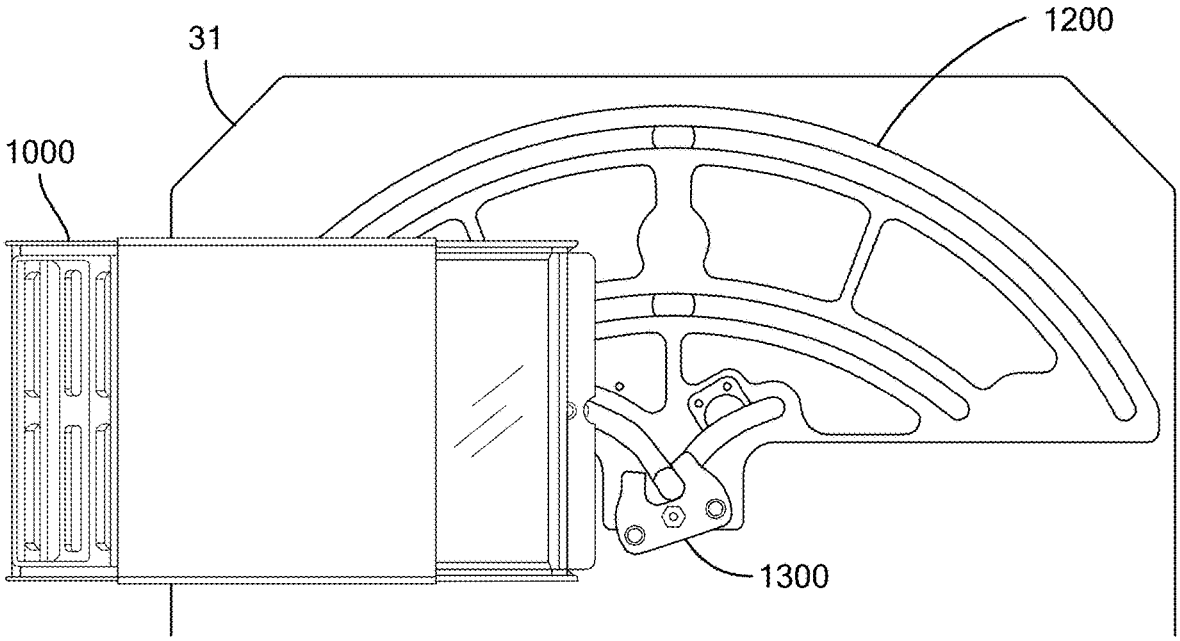
FIG. 10E illustrates a rear elevation view of the solid ballistic shield having the repositionable remote viewing scope of FIG. 10A, wherein the repositionable remote viewing scope is in a left side view position.
Figure 10F:
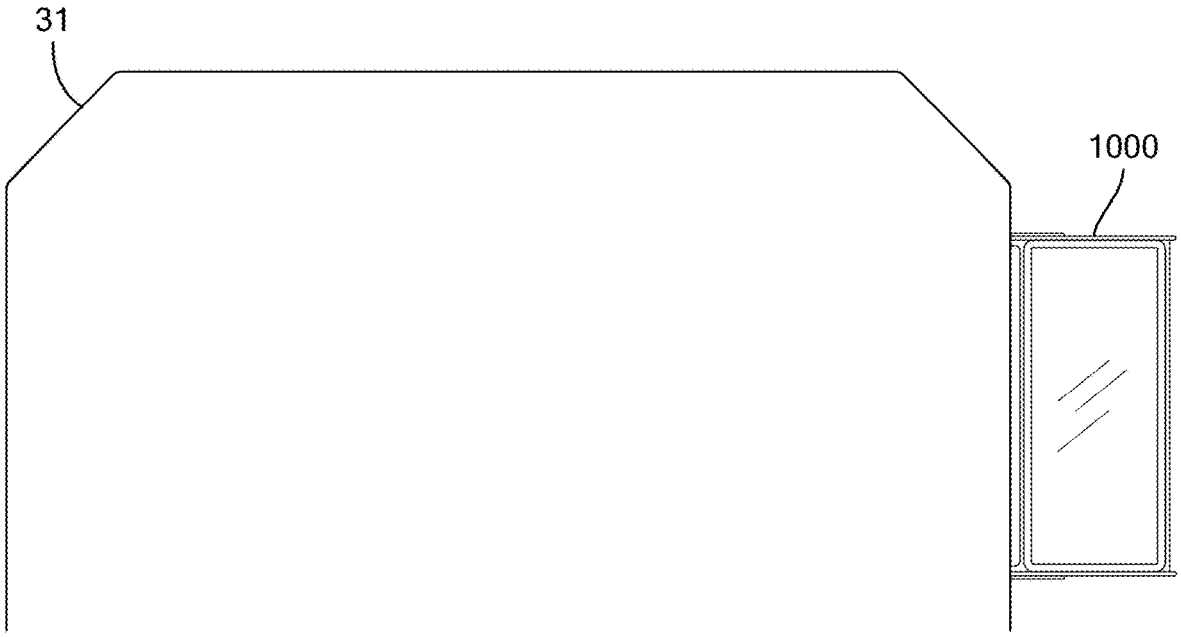
FIG. 10F illustrates a front elevation view of the solid ballistic shield having the repositionable remote viewing scope in the left side view position of FIG. 10E.
Figure 11A:
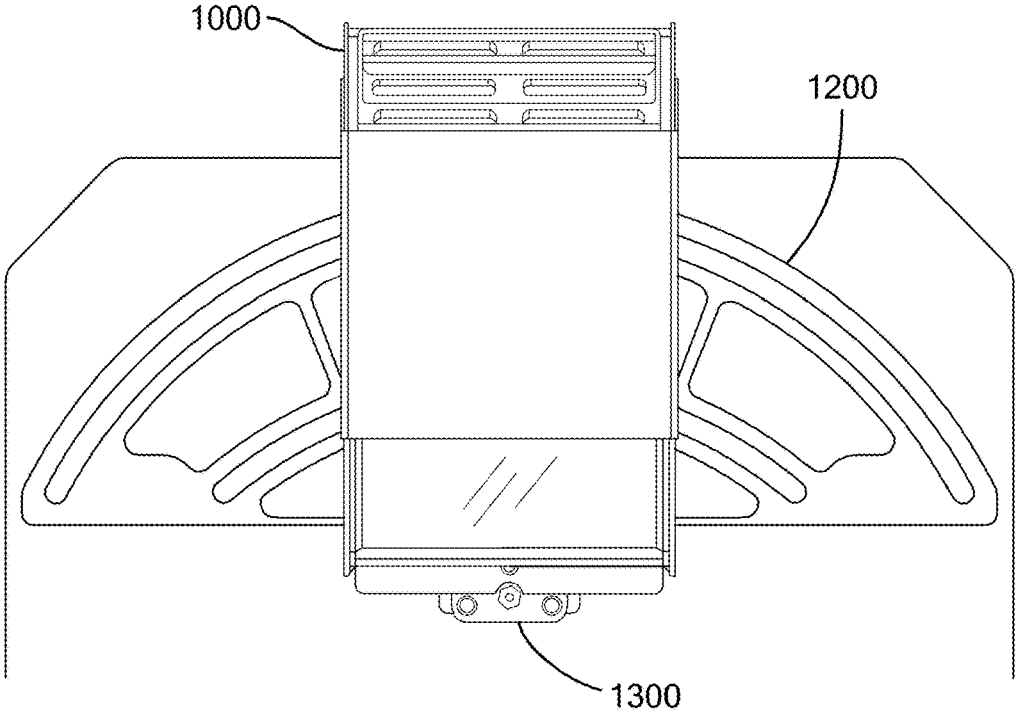
FIGS. 11A-11F illustrate a series of rear elevation views of the solid ballistic shield having the repositionable remote viewing scope of FIG. 10A, wherein the repositionable remote viewing scope is transitioned from the top view position to the right side view position.
Figure 11B:
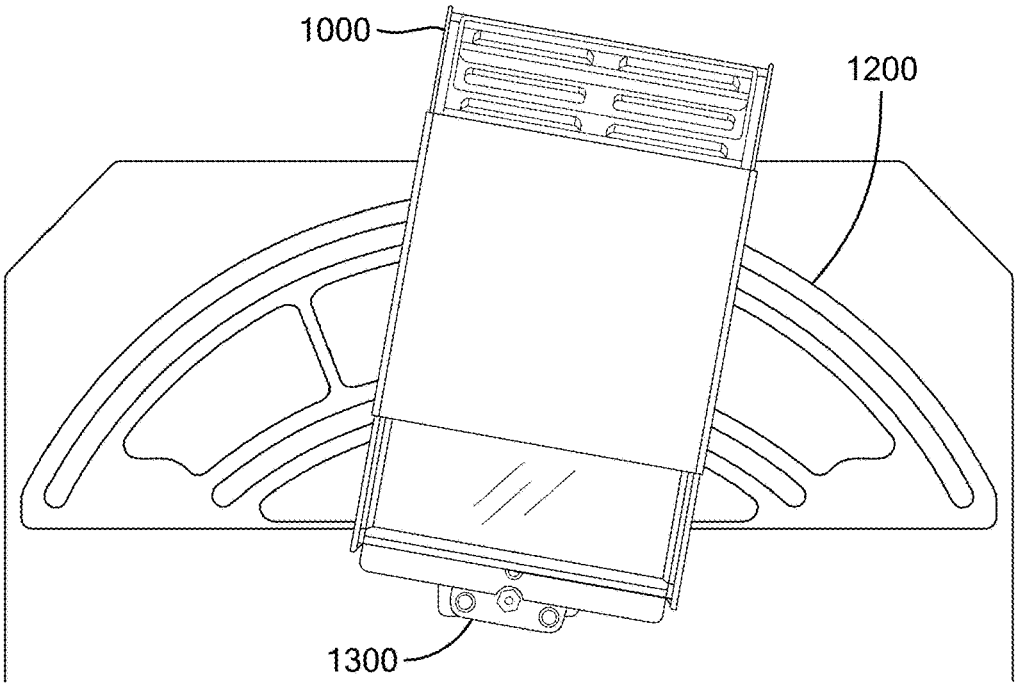
Figure 11C:
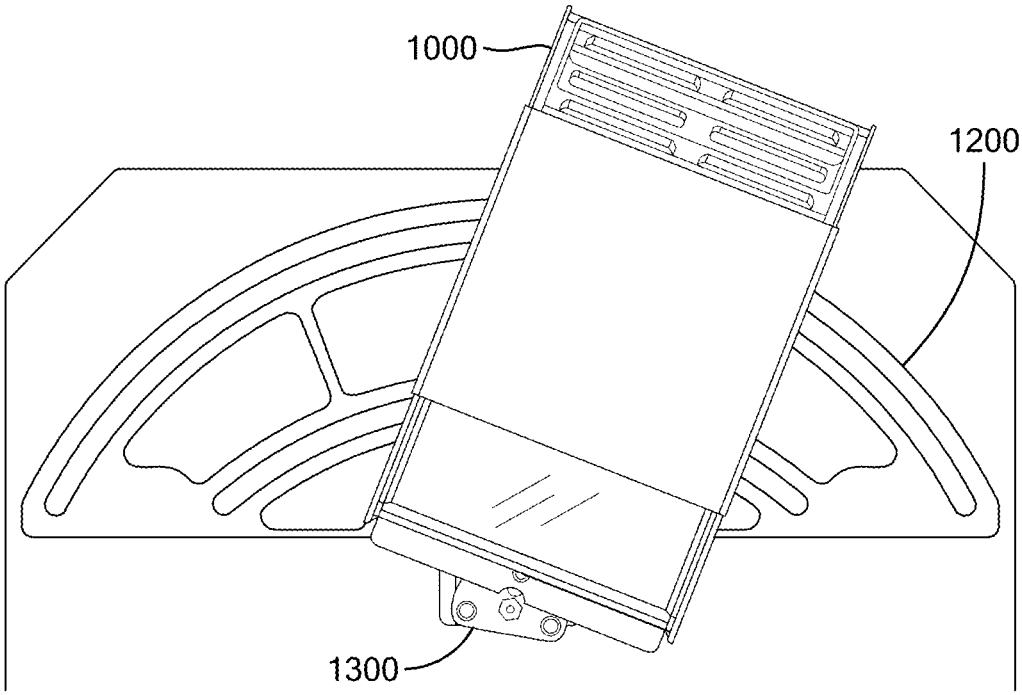
Figure 11D:
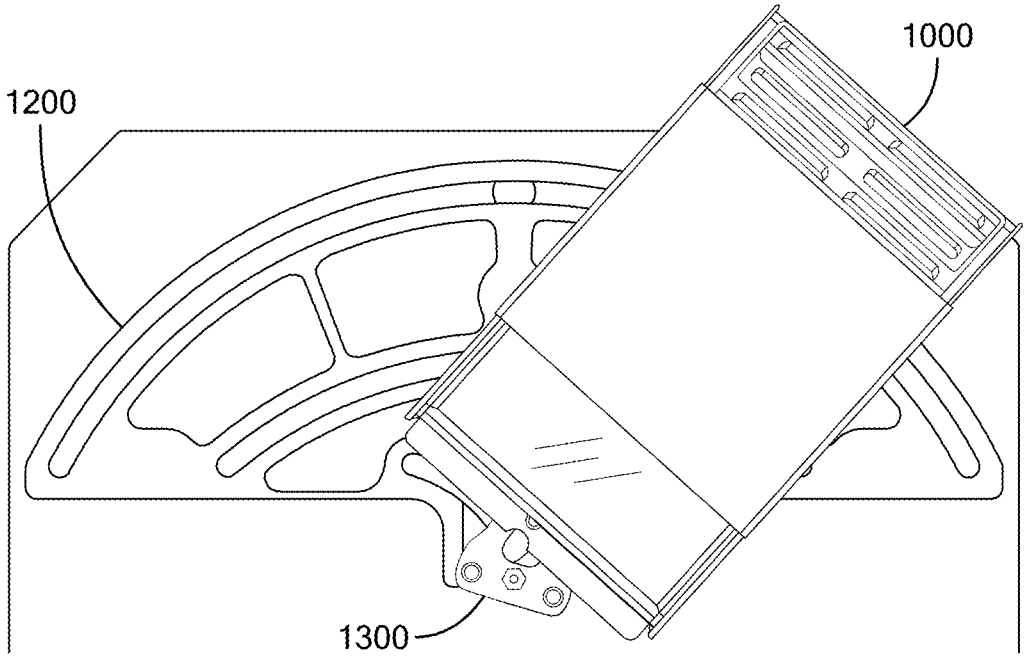
Figure 11E:
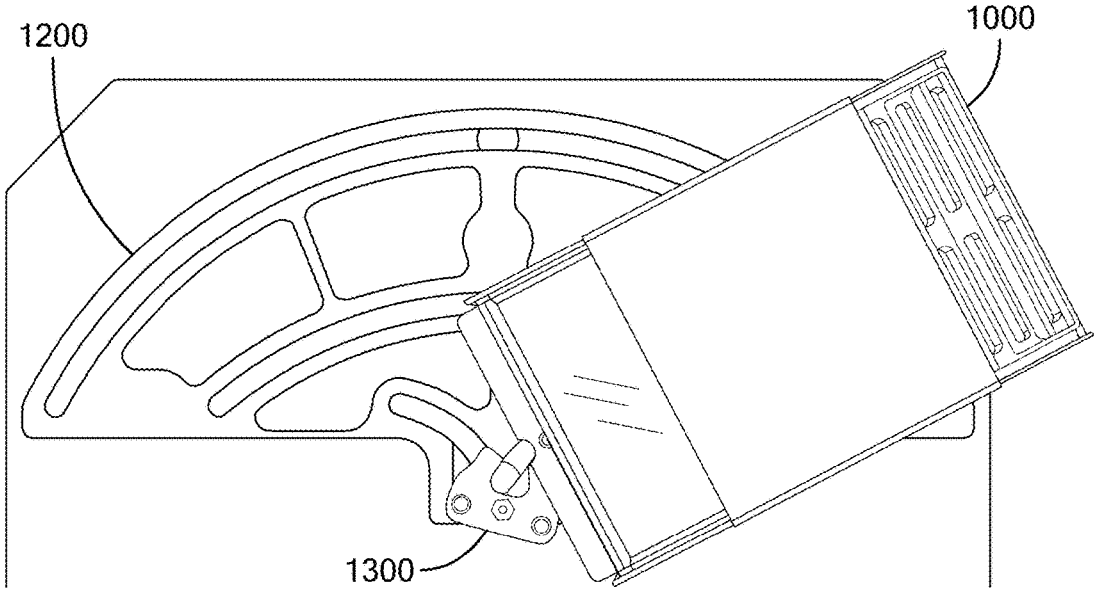
Figure 11F:
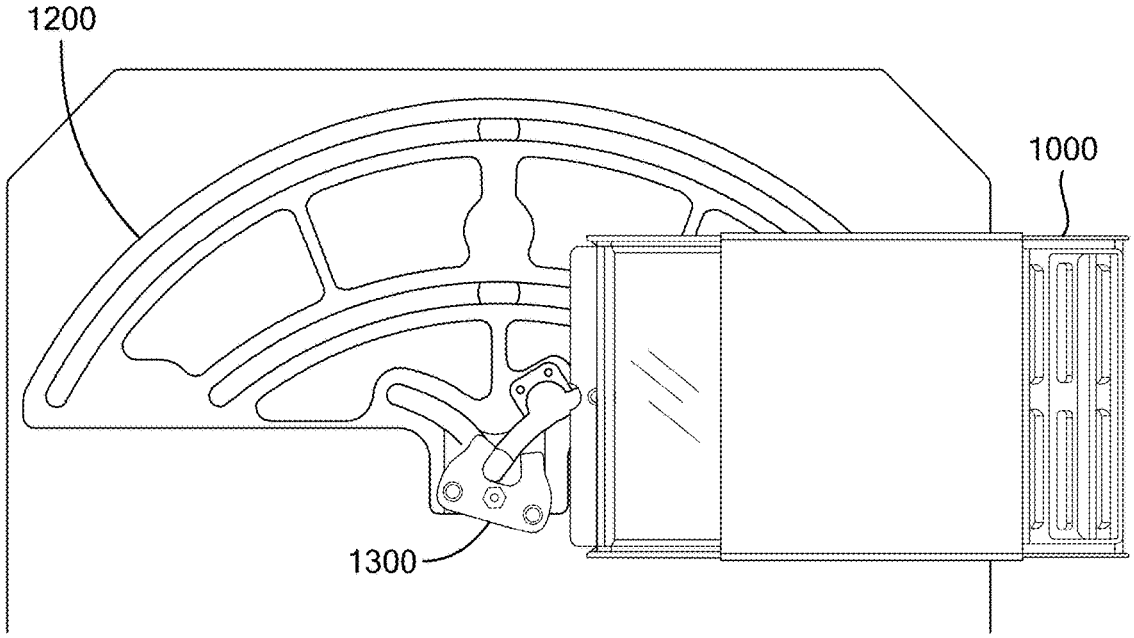
Figure 12:
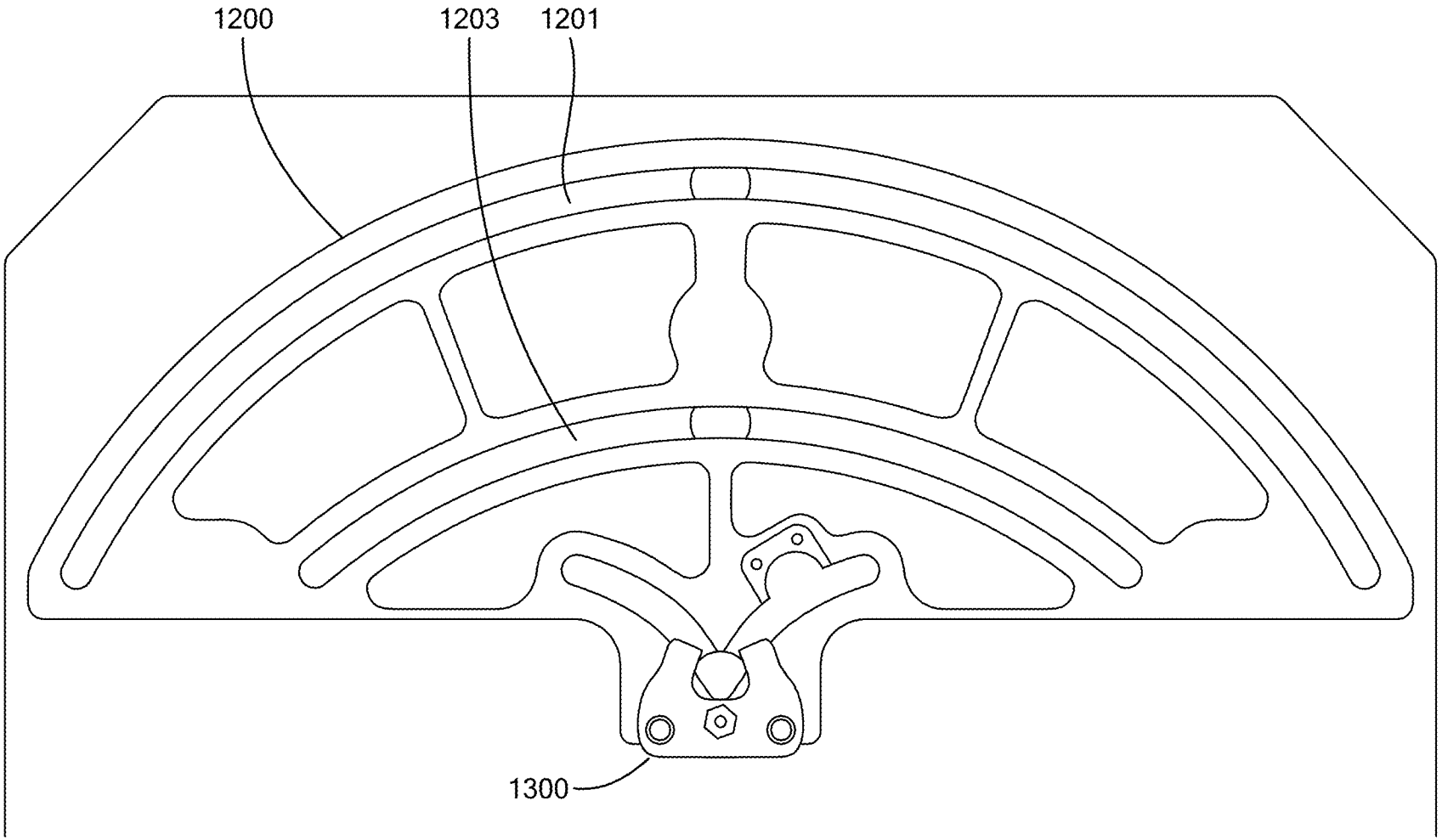
FIG. 12 illustrates a rear elevation view of a trackplate of the solid ballistic shield having the repositionable remote viewing scope of FIG. 10A.

Referring now to FIGS. 9A-9B, in some embodiments, the remote viewing shield 90 can be equipped with multiple remote viewing scopes (e.g., a top mount 300 and side mount 500 as shown). Such embodiments advantageously provide the user with tactical advantage regardless of circumstance. For example, a top mount viewing scope 300 can provide a more expansive field of view by virtue of being higher above the ground and is more central for a user seeking to be fully positioned behind the shield. By contrast, the side mount remote viewing scope 500 can be advantageous when the user needs to look around corners and/or use a side-arm or other weapon, thereby permitting the user to better aim at a target threat when discharging the weapon. More generally, remote viewing scopes 300, 500 can be mounted in any number and in any combination of positions along the edges of the solid shield in accordance with various embodiments.

Referring now to FIGS. 10A-10F and 11A-11F, in some embodiments, a remote viewing shield 100 can be provided with a repositionable remote viewing scope 1000 to further facilitate situational and preferential positioning of the remote viewing scope 1000. The basic optical components (e.g., tube 1003, viewing mirror 1005, and threat-side mirror 1001) of the remote viewing scope 1000, as well as the solid shield 31 itself, are generally similar to those used in connection with the top mount design of FIGS. 3A-3F and the side mount design of FIGS. 5A-5D. However, the repositionable remote viewing scope 1000 is configured to be repositioned between two or more of top and/or side mount configurations. As shown in FIGS. 10A-10F, for example, a repositionable remote viewing scope 1000 can be repositioned as need to provide any of a top (see FIGS. 10A-10B), right (see FIGS. 10C-10D), and/or left (see FIGS. 10E-10F) mount configuration. However, in some embodiments (not shown) the remote viewing scope may only be repositionable between two (e.g., right and left, top and right, top and left) positions. In some embodiments, the remote viewing scope can advantageously be selectively securable in each of the top mount position, the left side mount position, and/or the right side mount position by nay suitable selectively engageable means including, for example, one or more of mechanical or magnetic detents.

As shown herein, the remote viewing scope 1000 is configured to interoperate with a trackplate 1200 and a rocker guide 1300 to permit repositioning of the remote viewing scope 1000 for providing any of the top (see FIGS. 10A-10B), right (see FIGS. 10C-10D), or left (see FIGS. 10E-10F) mount configurations. However, it will be apparent in view of this disclosure that any suitable mechanism for repositioning the remote viewing scope can be used in accordance with various embodiments. For example, in some embodiments the remote viewing scope can be removably attachable to and repositionable on the shield 31 by one or more of hook and loop fasteners, keyhole hangers, hooks, clips, detent mechanisms such as ball detents, any other suitable means, or combinations thereof.

Referring now to FIGS. 11A-11F and 12, the trackplate 1200 can include an outer slot 1201 proximate an edge of the remote viewing shield 100 and an inner slot 1203 extending at least partially concentrically within the outer slot 1201. Each of the inner and outer slots 1201, 1203 can generally be sized to receive corresponding inner and outer engagement members (not shown) extending from a shield-facing side of the remote viewing scope 1000 for slidably engaging with the inner and outer slots 1201, 1203 to removably retain the remote viewing scope 1000 in the trackplate 1200 and, consequently, on the solid shield 31, as well as permitting slidable repositioning of the remote viewing scope 1000 relative to the solid shield 31 (e.g., from a top mount position to a right mount position as in FIGS. 11A-11F or from any top or side mount position to any other top or side mount position). In some embodiments, the trackplate 1200 can be attached to the solid shield 31 as shown. 12. In such embodiments the trackplate 1200 can be attached to the shield 31 by one or more of welding, lamination, adhesives, hook and loop fasteners, mechanical fasteners, or combinations thereof. However, in some embodiments, the trackplate 1200 can instead be integrally formed within the solid shield 31.

Referring now to FIGS. 12 and 13A-13C, the remote viewing shield 100 can also include a rocker guide 1300 positioned radially inward from the inner and outer slots 1201, 1203 and can include a rocker 1305, a right guide slot 1301, and a left guide slot 1303. Each of the left and right guide slots 1301, 1303 can generally be sized to receive a corresponding guide engagement member (not shown) extending from the shield-facing side of the remote viewing scope 1000 for slidably engaging with the left and right guide slots 1301, 1303 to aid in removably retaining the remote viewing scope 1000 in the rocker guide 1300 and, consequently, on the solid shield 31, as well as permitting slidable repositioning of the remote viewing scope 1000 relative to the solid shield 31 (e.g., from a top mount position to a right mount position as in FIGS. 11A-11F or from any top or side mount position to any other top or side mount position). In some embodiments, the left and right guide slots 11301, 1303 can be a separate piece attached to the solid shield 31 and/or can be integrally formed in the trackplate 1200 and/or the solid shield 31.

Figure 13C:
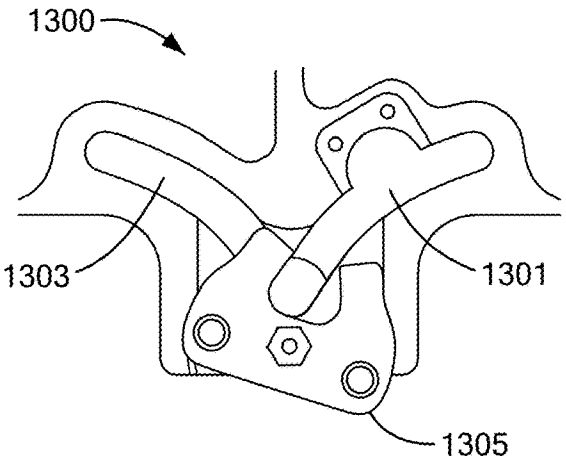
FIG. 13C illustrates a rear elevation detail view of a rocker guide of the solid ballistic shield having the repositionable remote viewing scope in the right side view position of FIG. 10C, wherein the rocker guide is in a rightward configuration corresponding to the left side view position of FIGS. 10C-10D and 11F.
Figure 13B:
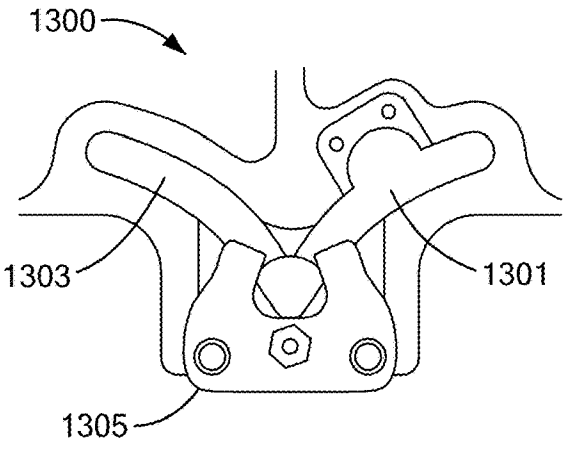
FIG. 13B illustrates a rear elevation detail view of a rocker guide of the solid ballistic shield having the repositionable remote viewing scope in the top view position of FIG. 10A, wherein the rocker guide is in a vertical configuration corresponding to the top view position of FIGS. 10A-10B and 11A.
Figure 13A:
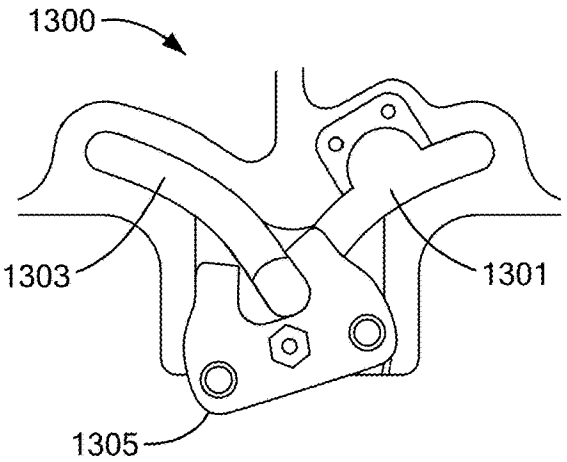
FIG. 13A illustrates a rear elevation detail view of a rocker guide of the solid ballistic shield having the repositionable remote viewing scope in the left side view position of FIG. 10E, wherein the rocker guide is in a leftward configuration corresponding to the left side view position of FIGS. 10E-10F.

As shown in FIGS. 13A-13C, the rocker 1305 can rock/tilt left or right responsive to movement by an operator of the repositionable remote viewing scope 1000. When the rocker 1305 is positioned for a top mount configuration, a bottom of the remote viewing scope 1000 can rest on the rocker for vertical alignment. If the operator wishes to transition the remote viewing scope 1000 to a right side mount configuration, the operator can slide the remote viewing scope 1000 toward the right such that the inner and outer engagement members slide rightward within the inner and outer slots 1201, 1203 of the trackplate 1200, thereby causing the rocker 1305 to tilt toward the right until the guide engagement member is aligned with the right guide slot 1301, at which point the guide engagement member of the remote viewing scope 1000 is able to translate rightward within the right guide slot 1301 until the remote viewing scope 1000 reaches the right mount position.

Similarly, if the operator wishes to transition the remote viewing scope 1000 to a left side mount configuration, the operator can slide the remote viewing scope 1000 toward the left such that the inner and outer engagement members slide leftward within the inner and outer slots 1201, 1203 of the trackplate 1200, thereby causing the rocker 1305 to tilt toward the left until the guide engagement member is aligned with the left guide slot 1303, at which point the guide engagement member of the remote viewing scope 1000 is able to translate leftward within the left guide slot 1303 until the remote viewing scope 1000 reaches the left mount position.

In some embodiments, the solid shield 31 may be dimensioned such that the inner and outer slots 1201, 1203 of the trackplate 1200 may be perfectly concentric 180 degree arcs and still provide optimum viewing alignment in all three positions (left, right, top). In such embodiments, there may be no need for the right and left guide slots 1301, 1303 and/or even the rocker 1305 itself as the remote viewing scope is repositionable by strictly rotational movement. Alternatively, in such dimensional scenarios the trackplate 1200 can be omitted and the remote viewing scope 1000 can instead be repositioned by, for example, point rotation about a pin or other shaft.

However, in many embodiments, the solid shield 31 may be dimensioned such that a distance from the bottom of the remote viewing scope 1000 to the top of the solid shield 31 is different from (e.g., larger than) a distance from a vertical centerline axis of the solid shield 31 to the left and right edges. In such embodiments, both rotation and translation of the remote viewing scope 1000 may be required in order to achieve all three positions. In such embodiments, the inner and outer slots 1201, 1203 may not be perfectly concentric and it is the right and left guide slots 1301, 1303 that provide for such translational movement. Furthermore, although shown and described herein in the context of sliding within slots, in some embodiments a similar rotation and translation functionality can be achieved via the use of a more complex mechanism such as, for example, a four bar linkage mechanism.

Figure 14A:
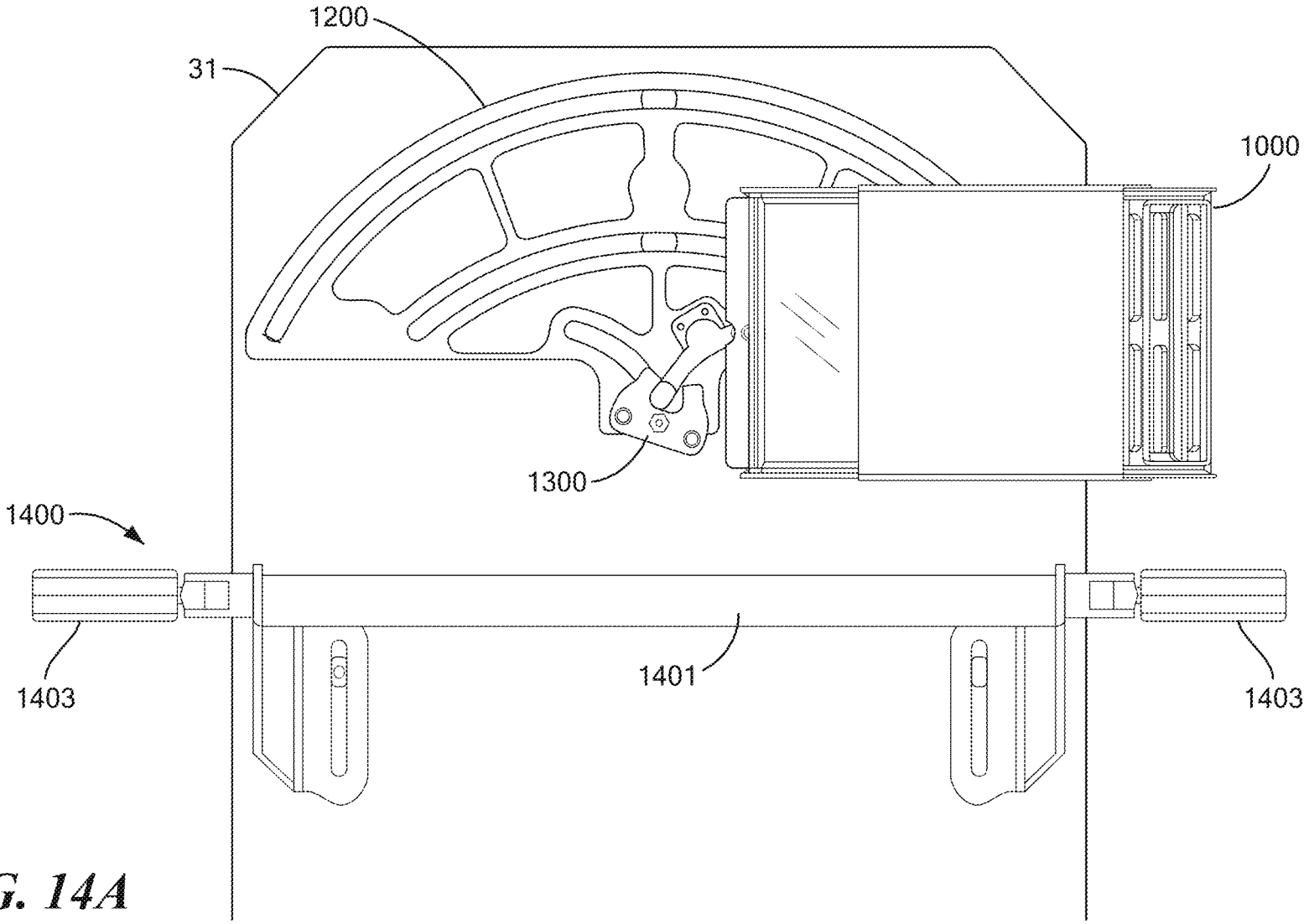
FIG. 14A illustrates a rear elevation detail view of a handle assembly of the solid ballistic shield having the repositionable remote viewing scope in the right side view position of FIG. 10C.
Figure 14B:
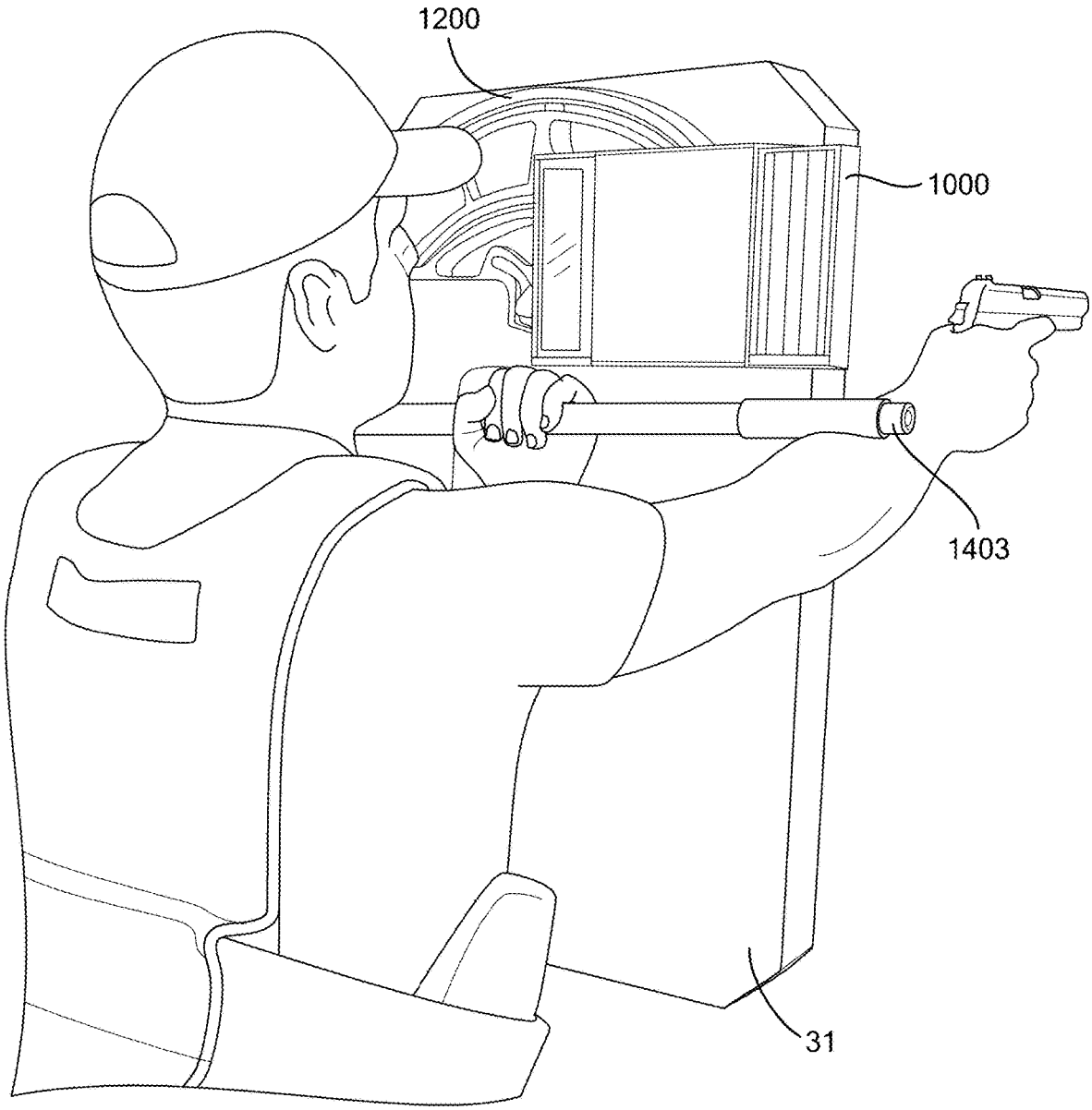
FIG. 14B illustrates a perspective view of a user using the handle assembly of FIG. 14A to wield the solid ballistic shield having the repositionable remote viewing scope in the right side view position of FIG. 10C.

As shown in FIGS. 14A-14B, in some embodiments the remote viewing shield 100 may also include a handle assembly 1400 including a handle 1401 for providing the operator with means to support the remote viewing shield 100 and opposing left and right grips 1403, which can also serve a similar function to forearm supports 700 as discussed above. For example, as shown in FIG. 14B, the grips 1403 provide for additional stability of the remote viewing shield 100, regardless of whether the repositionable remote viewing scope 1000 is in a left mount or right mount position. Such grips 1403 can be useful, for example, when one of the user's arms is holding a weapon as in FIG. 14B so that the user does not need to support the entire shield with only a single hand.

While example embodiments have been particularly shown and described, it will be understood by those skilled in the art that various changes in form and details may be made therein without departing from the scope of the embodiments encompassed or contemplated herein.

As used herein, "consisting essentially of" allows the inclusion of materials or steps that do not materially affect the basic and novel characteristics of the claim. Any recitation herein of the term "comprising", particularly in a description of components of a composition or in a description of elements of a device, can be exchanged with "consisting essentially of" or "consisting of".

The invention claimed is:

1. A remote viewing shield comprising:

a ballistic shield;

a remote viewing scope mounted to the ballistic shield and including a viewing port located behind the ballistic shield and positioned to permit user viewing of threats in front of the ballistic shield by looking around the ballistic shield;

wherein the remote viewing scope is repositionable between a top mount position to provide a view over a top of the ballistic shield and one or more side positions to provide a view around a side of the ballistic shield, the one or more side positions including a left side mount position and a right side mount position;

wherein the remote viewing scope is at least one of:

selectively securable in each of the top mount position, the left side mount position, and the right side mount position by one or more of mechanical or magnetic detents;

removably attachable to and/or repositionable on the ballistic shield by one or more of hook and loop fasteners, keyhole hangers, hooks, clips, a detent mechanism, or combinations thereof;

repositionable by rotation and/or translation of the remote viewing scope within one or more slots; or a combination thereof.

2. The remote viewing shield of claim 1, wherein the remote viewing scope is mounted at a top of the ballistic shield to provide a view over a top of the ballistic shield.

3. The remote viewing shield of claim 2, further comprising a second remote viewing scope mounted at a side of the ballistic shield to provide a view around the side of the ballistic shield.

4. The remote viewing shield of claim 1, wherein the remote viewing scope is mounted at a side of the ballistic shield to provide a view around the side of the ballistic shield.

5. The remote viewing shield of claim 1, further comprising a trackplate attached to or formed in the ballistic shield and having one or more slots configured to slidably engage an engagement member of the repositionable remote viewing scope.

6. The remote viewing shield of claim 5, wherein the trackplate is attached to the ballistic shield by one or more of welding, lamination, adhesives, hook and loop fasteners, mechanical fasteners, or combinations thereof.

7. The remote viewing shield of claim 5, wherein the trackplate further comprises:

an outer slot, and an inner slot extending at least partially concentrically within the outer slot, wherein the inner and outer slots are configured to slidably engage inner and outer engagement members of the repositionable remote viewing scope.

8. The remote viewing shield of claim 1, further comprising a rocker guide including a rocker configured to tilt responsive to sliding of the engagement member of the repositionable remote viewing scope within the one or more slots of the trackplate.

9. The remote viewing shield of claim 8, wherein the rocker guide further comprises one or more guide slots configured to slidably engage a guide engagement member of the repositionable remote viewing scope, wherein tilting of the rocker aligns the guide engagement member with one of the one or more guide slots to permit sliding of the engagement member within the aligned one of the one or more guide slots.

10. The remote viewing shield of claim 9, wherein:

the trackplate further comprises:

an outer slot, and an inner slot extending at least partially concentrically within the outer slot, wherein the inner and outer slots are configured to slidably engage inner and outer engagement members of the repositionable remote viewing scope; and the rocker guide further comprises left and right guide slots configured to slidably engage the guide engagement member of the repositionable remote viewing scope, wherein tilting the rocker rightward aligns the guide engagement member with the right guide slot to permit sliding of the engagement member within the right guide slot and wherein tilting the rocker leftward aligns the guide engagement member with the left guide slot to permit sliding of the engagement member within the left guide slot.

11. The remote viewing shield of claim 1, further comprising mirrors and/or prisms configured to facilitate remote viewing.

12. The remote viewing shield of claim 11, wherein the mirrors and/or prisms are each at least one of flat, convex, or concave.

13. The remote viewing shield of claim 11, wherein the remote viewing scope is stowable to protect the mirrors and/or prisms when not in use.

14. The remote viewing shield of claim 11, wherein at least one of the mirrors and/or prisms includes a one-way mirror to obfuscate a user's face.

15. The remote viewing shield of claim 1, wherein the remote viewing scope is configured to fold flat onto a back of the ballistic shield.

16. The remote viewing shield of claim 1, wherein the remote viewing scope facilitates aiming of a defensive weapon by a user by providing a view through sights or a scope of the defensive weapon while a user's head is fully positioned behind the ballistic shield.

17. The remote viewing shield of claim 1, further comprising a forearm support device (FSD) configured to be at least partially supported by a user's forearm to aid in supporting a ballistic shield.

18. The remote viewing shield of claim 17, wherein the FSD is mounted on at least one of a left or right side of the ballistic shield.

19. The remote viewing shield of claim 17, wherein the FSD is configured to be used in combination with a handle of the remote viewing shield.

20. The remote viewing shield of claim 19, wherein the FSD is integrated with the handle.

21. The remote viewing shield of claim 17, wherein the FSD is configured to function as a steadying device for a forearm of an arm holding a weapon.

22. The remote viewing shield of claim 17, wherein the FSD is adjustable to position a user's forearm for aiming of a weapon by the remote viewing scope.

23. The remote viewing shield of claim 1, further comprising a hand shield device mounted to the ballistic shield and configured to protect a user's hand when reaching around a ballistic shield.

24. The remote viewing shield of claim 23, wherein the hand shield is adjustable in at least one dimension relative to the ballistic shield.

25. The remote viewing shield of claim 23, wherein the hand shield device is mounted on at least one of a left or right side of the ballistic shield.

26. The remote viewing shield of claim 23, wherein the hand shield is configured to function as a steadying device for a weapon held by a user of the remote viewing shield.

27. The remote viewing shield of claim 1, wherein the ballistic shield includes a transparent insert or window.

28. The remote viewing shield of claim 1, wherein the ballistic shield does not include a transparent insert in the ballistic shield.

* * * * *